US005833423A

United States Patent [19]

Yamaguchi et al.

[11] Patent Number: 5,833,423

[45] Date of Patent: Nov. 10, 1998

[54] BIND TAPE USED WITH BOOKBINDING APPARATUS

[75] Inventors: Yoshimasu Yamaguchi, Kawasaki; Toshihiko Kusumoto, Yokohama; Ryuichi Iwanaga, Tokyo; Hideaki Kosasa, Tokyo; Hiroshi Ota, Tokyo; Yuji Yamanaka, Kawasaki; Kozo Sakakibara, Yokohama, all of Japan

[73] Assignee: Canon Kabushiki Kaisha, Tokyo, Japan

[21] Appl. No.: 608,369

[22] Filed: Feb. 28, 1996

[30] Foreign Application Priority Data

| | | | |
|---|---|---|---|
| Mar. 1, 1995 | [JP] | Japan | 7-042185 |
| Jan. 19, 1996 | [JP] | Japan | 8-007913 |

[51] Int. Cl.[6] ..... B42C 9/00

[52] U.S. Cl. ..... 412/8; 412/36; 412/33

[58] Field of Search ..... 412/8, 1, 6, 9, 412/33, 34, 36, 901, 900, 902

[56] References Cited

U.S. PATENT DOCUMENTS

| | | | |
|---|---|---|---|
| 2,897,522 | 8/1959 | Fotiades | 412/36 X |
| 3,847,718 | 11/1974 | Watson | 428/55 |
| 5,052,873 | 10/1991 | Parker et al. | 412/36 |

FOREIGN PATENT DOCUMENTS

| | | |
|---|---|---|
| 2318036 | 2/1977 | France . |
| 2237583 | 5/1973 | Germany . |
| 2456341 | 8/1976 | Germany . |
| WO9405508 | 3/1994 | WIPO . |

*Primary Examiner*—Willmon Fridie, Jr.

*Attorney, Agent, or Firm*—Fitzpatrick, Cella, Harper & Scinto

[57] ABSTRACT

A bind tape abutted against a bound edge of a sheet bundle for book-binding the sheet bundle includes a tape substrate and an adhesive layer coated on one surface of the tape substrate to bond the sheet bundle. The bind tape is provided at both longitudinal end portions thereof with areas on which the adhesive layer is not coated.

10 Claims, 33 Drawing Sheets

FIG.11A
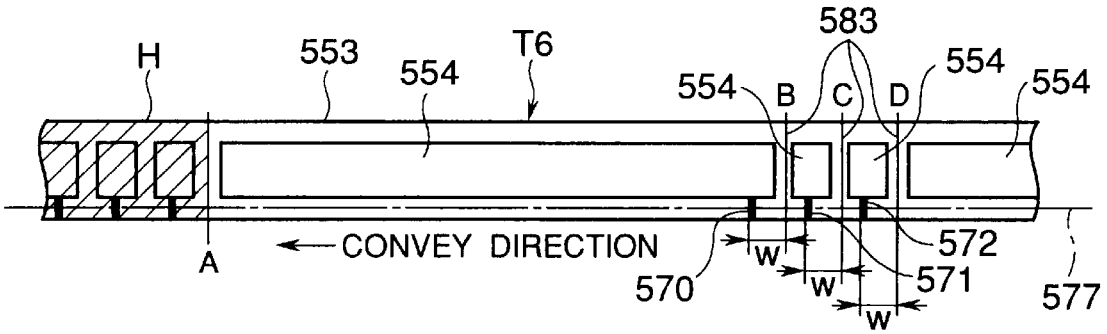
FIG.11B
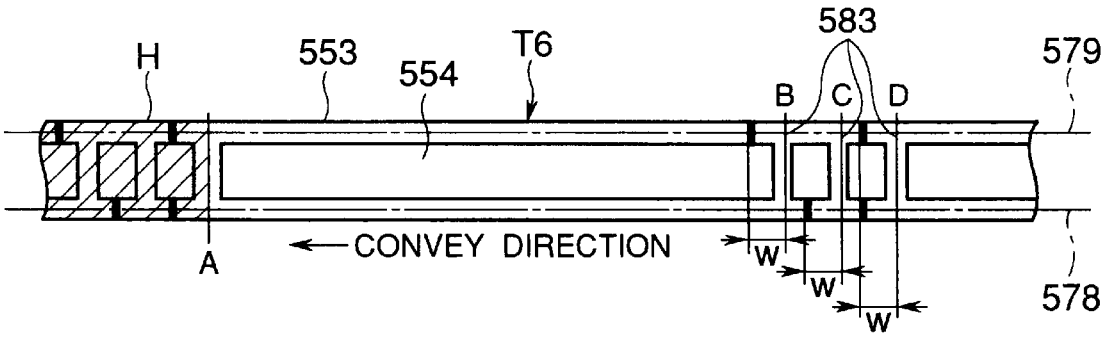
FIG.11C
| | A | B | C | D |
|---|---|---|---|---|
| OUT OF SENSOR 1 | ON | ON | OFF | ON |
| OUT OF SENSOR 2 | ON | OFF | ON | ON |
| CORRESPONDING SIZE | A4 | B5 | LTR | A4 |

BIND TAPE USED WITH BOOKBINDING APPARATUS

BACKGROUND OF THE INVENTION

1. Field of the Invention

The present invention relates to a wound bind tape used with a bookbinding apparatus in which a sheet bundle is automatically glued.

2. Related Background Art

There have been proposed on-line systems in which a series of treatments from an image forming operation on sheets to a bookbinding operation for binding the imaged sheets are continuously performed. In these on-line systems, a plurality of imaged sheets (sheet bundle) are glued to effect the bookbinding. In the bookbinding using the gluing operation, a strip-shaped bind tape on which hot melt adhesive is coated is used.

When the imaged sheets being shifted in the on-line system is bookbound, first of all, the imaged sheets being moved are stacked on an alignment tray, thereby aligning the sheets on the alignment tray. Then, a bind tape cut in a strip shape is positioned at a bound edge of a sheet bundle comprised of the aligned sheets. Then, the bind tape is heated by a heater to melt the hot melt adhesive. The molten hot melt adhesive enters between the sheets, thereby gluing the sheet bundle. In this case, left and right side heaters serve to bend left and right lateral edge portions of the bind tape, whereby bonding the lateral edge portions to front and rear surfaces of the sheet bundle.

FIGS. 33A and 33B show a conventional wound bind tape used with an on-line system. The wound bind tape is set within the on-line system in a coiled condition so that, when the bind tape is supplied to a bookbinding position, the tape is cut to a predetermined length (strip-shape) by a cutter.

A thin hot melt adhesive layer 901 and a thick hot melt adhesive layer 902 are coated on the same surface of a tape substrate 900. The thin hot melt adhesive layer 901 serves to adhere both lateral edge portions of the bind tape to the front and rear surfaces of the sheet bundle and is coated on the tape substrate 900 over the entire width and entire length thereof. On the other hand, the thick hot melt adhesive layer 902 serves to glue the sheet bundle and is coated on the thin adhesive layer at a central portion of the tape substrate 900 in the width-wise direction thereof and extends along the entire length of the tape substrate.

Several kinds of wound bind tapes having different tape widths are prepared, so that any bind tape having the optimum width depending upon a thickness of the sheet bundle can be selected and used. The reason for differentiating the tape widths for various bind tapes is that the width of the thick hot melt adhesive layer 902 must be changed in accordance with the thickness of the sheet bundle to be treated. In use, for a sheet bundle having a particular thickness, a bind tape with a thick hot melt adhesive layer 902 having a width slightly greater than the particular thickness.

However, when the bookbinding is performed by using the above-mentioned conventional wound bind tape, there arises a problem that the hot melt adhesive is apt to leak from the tape substrate. That is to say, the bind tape is cut in the strip shape and is supplied to the bookbinding position, and then is heated by the heater. Thereafter, the bound edge of the sheet bundle is urged against the heated bind tape to glue the sheet bundle. When the bound edge of the sheet bundle is urged against the bind tape, a part of the molten hot melt adhesive on the bind tape enters between the sheets, thereby bonding the sheets to each other.

However, in the conventional bind tapes, the hot melt adhesive which did not enter between the sheets is forcibly flown by the sheet bundle, thereby leaking the adhesive from both longitudinal ends (cut ends) of the tape. In the conventional bind tapes, since the thick hot melt adhesive layer 902 is coated on the bind tape cut in the strip shape over the entire length thereof (from one longitudinal end to the other longitudinal end), when the hot melt adhesive which did not enter between the sheets is forcibly flown by the sheet bundle, the adhesive is apt to leak from both longitudinal ends of the tape.

If the hot melt adhesive leaks from the book-bound sheet bundle, since the adhesive is adhered to a high temperature surface of the heater, the following disadvantages will occur:

(1) When the book-bound sheet bundle tries to be separated from the heater, the molten hot melt adhesive is threaded between the book-bound sheet bundle and the heater to form adhesive filaments or threads, with the result that, since the adhesive filaments are adhered to the surface of the book-bound sheet bundle, the appearance of the sheet bundle is worsened.

(2) In order to remove the hot melt adhesive adhered to the heater from the heater, the temperature of the heater must be decreased to a room temperature (safety condition) which requires a long waiting time, and, then, the adhesive must be scraped off from the heater by using a scraping tool such as a spatula. And, when the bookbinding operation is re-started, the heater must be heated again. Therefore, the productivity of the entire on-line system is greatly decreased.

If the bookbinding operation is continued without removing the adhesive adhered to the heater surface, the hot melt adhesive adhered to the heater surface will be transferred to the bind tape, thereby worsening the appearance of the book-bound sheet bundle.

Further, if the hot melt adhesive adhered to the surface of the heater tries to be removed in the high temperature condition without turning OFF the power source of the heater, since the high temperature hot melt adhesive adhered to the heater surface is hard to be peeled, it is very difficult to remove the adhesive from the heater surface completely.

(3) When the book-bound sheet bundle is separated from the heater, since pieces of the hot melt adhesive are frequently adhered to parts in the apparatus or are dropped within the apparatus, the malfunction of the apparatus may occur. Thus, the apparatus must be cleaned periodically.

FIG. 34 shows a relation between the sheet bundle SA and the thick hot melt adhesive layer 902 coated on the bind tape T. As shown, when the both lateral edge portions of the bind tape T is bent by the left and right side heaters, both lateral edge portions of the thick hot melt adhesive layer 902 are also bent to abut against the front and rear surfaces of the sheet bundle. Incidentally, in fact, since the width of the thick hot melt adhesive layer 902 is slightly greater than the thickness of the sheet bundle SA, the amount of the lateral edge portions of the thick hot melt adhesive layer bent toward the front and rear surfaces of the sheet bundle is smaller than that shown in FIG. 34.

However, when the hot melt adhesive bent toward the front and rear surfaces is molten to flow toward the bound edge of the sheet bundle SA, as shown in FIG. 35, since the above-mentioned leakage of the hot melt adhesive is enhanced or promoted, conventionally, by decreasing the urging pressure of the left and right side heaters and/or decreasing the temperature of the side heaters, it is prevented that the molten hot melt adhesive from flowing toward the bound edge of the sheet bundle SA. In this case, however, since the bound edge of the sheet bundle SA is swollen, the appearance of the book-bound sheet bundle SA is worsened, and, when a plurality of sheet bundles are laminated or overlapped, the entire stability is also worsened.

SUMMARY OF THE INVENTION

The present invention aims to eliminate the above-mentioned conventional drawbacks, and an object of the present invention is to provide a bind tape by which the leakage of hot melt adhesive can be prevented from leaking from a book-bound sheet bundle.

To achieve the above object, according to the present invention, there is provided a bind tape for abutting against a bound edge of a sheet bundle to book-bind the sheet bundle, comprising a tape substrate, and an adhesive layer coated on one surface of the tape substrate and adapted to bond the sheet bundle, and wherein the bind tape is provided at its both longitudinal end portions with areas on which the adhesive layer is not coated.

The present invention further provides a bind tape for abutting against a bound edge of a sheet bundle to book-bind the sheet bundle, comprising a tape substrate, and adhesive layers for bonding the sheet bundle, and wherein the adhesive layers are disposed on one surface of the tape substrate at a predetermined interval along a longitudinal direction of the bind tape.

A tape supplying apparatus for supplying the bind tape according to the present invention comprises a bind tape containing means for containing a bind tape comprising a tape substrate and adhesive layers for bonding a sheet bundle and wherein the adhesive layers are disposed along a longitudinal direction with a predetermined block pattern in dependence upon sizes of sheet bundles, a convey means for conveying the bind tape contained in the bind tape containing means, a cutting means for cutting the bind tape conveyed by the convey means, in accordance with the size of the sheet bundle to be book-bound, and a control means for controlling the cutting means in such a manner that the bind tape is cut at a position on which the adhesive layer is not coated between the blocks of the block pattern.

BRIEF DESCRIPTION OF THE DRAWINGS

FIGS. 11A to 11C are views showing an arrangement of markings as references for cutting position for the bind tape of the present invention;

DETAILED DESCRIPTION OF THE PREFERRED EMBODIMENTS

The present invention will now be explained in connection with embodiments thereof with reference to the accompanying drawings.

<First Embodiment>

Figure 1A:
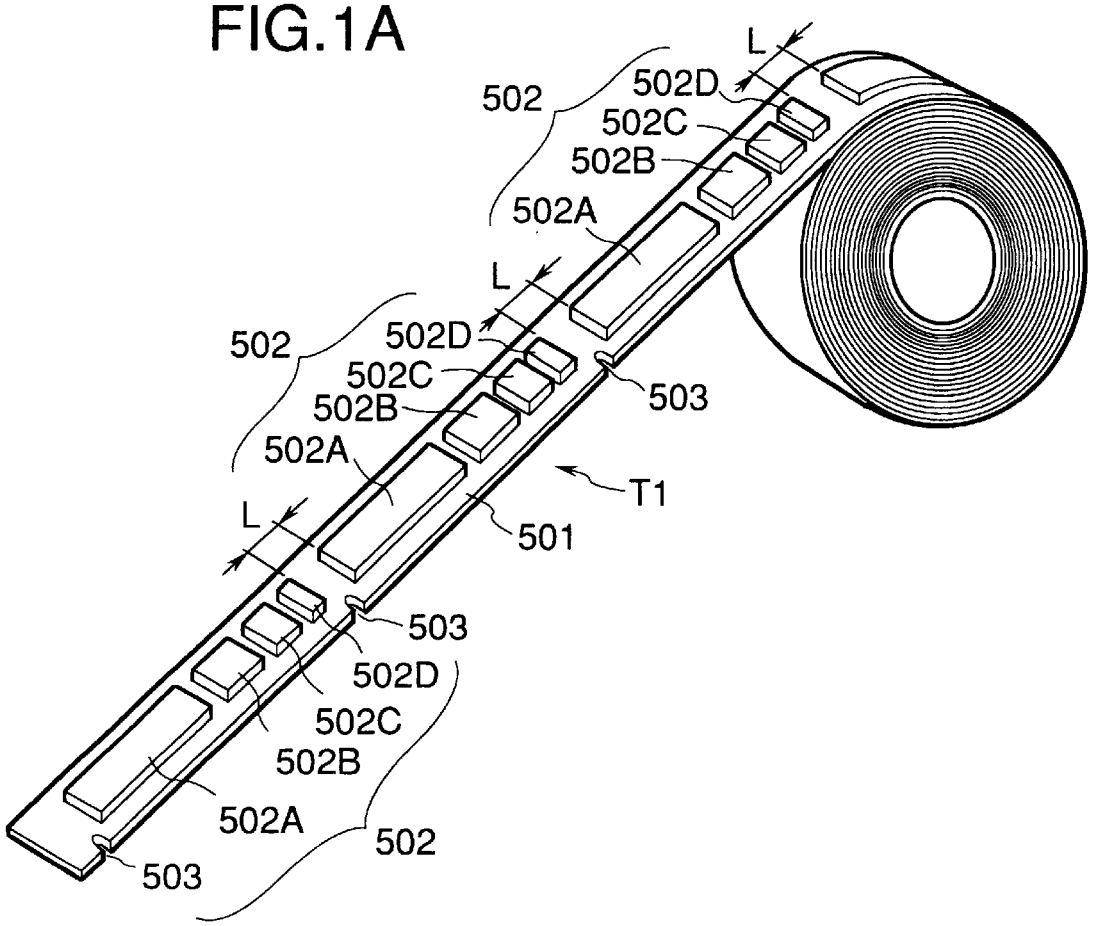
FIG. 1A is a perspective view of a wound bind tape according to a first embodiment of the present invention.
Figure 1B:
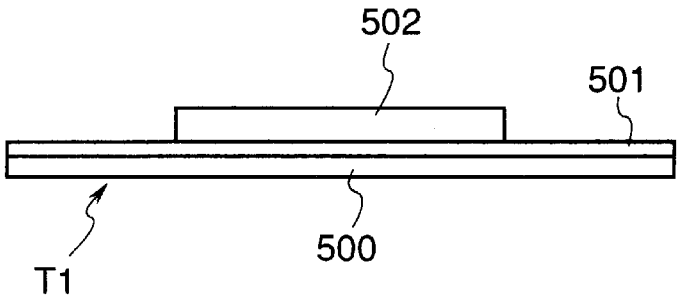
FIG. 1B is a sectional view of the bind tape.

FIGS. 1A and 1B show a construction of a wound bind tape according to a first embodiment of the present invention. FIG. 1A is a perspective view of the bind tape, and FIG. 1B is a sectional view of the bind tape.

The wound bind tape T1 has a thin hot melt adhesive layer 501 coated on one surface of a tape substrate 500, and thick hot melt adhesive layers 502 coated on the same surface of the tape substrate. Although the tape substrate 500 is normally formed from fibrous material such as paper, non-woven fabric, cloth or the like, it may be formed from a plastic film made of polyester, polycarbonate or the like. On the other hand, the hot melt adhesive layers 501, 502 may be an adhesive having ethylene-vinyl acetate copolymer resin (EVA), adhesive polyethylene group, polyamide group, polybutylal group or the like as base agent.

The thin hot melt adhesive layer 501 serves to adhere both lateral edge portions of the bind tape to front and rear surfaces of a sheet bundle and is coated on the entire surface of the tape substrate 500. On the other hand, the thick hot melt adhesive layers 502 serve to glue the sheet bundle and constitute block patterns each of which is used by the respective bookbinding process, and the block patterns are disposed along a longitudinal direction of the tape at a predetermined distance or interval (L).

In the illustrated embodiment, the block pattern for each bookbinding process is constituted by a plurality of blocks 502A, 502B, 502C, 502D disposed along the longitudinal direction of the tape at a predetermined distance so that the block pattern can be accommodated to sheet bundles having different sizes.

Figure 2B:
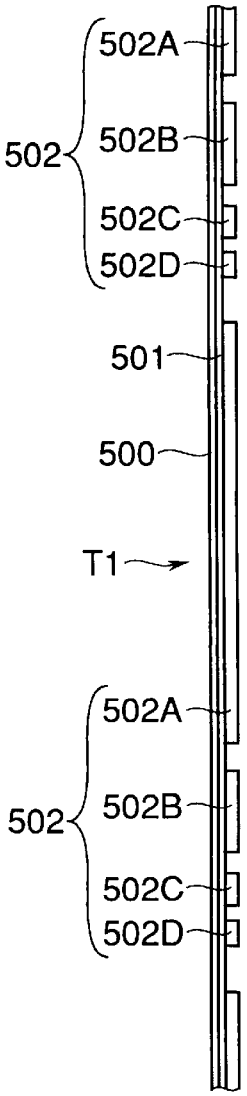
FIG. 2B is a side view showing the block pattern.
Figure 2A:
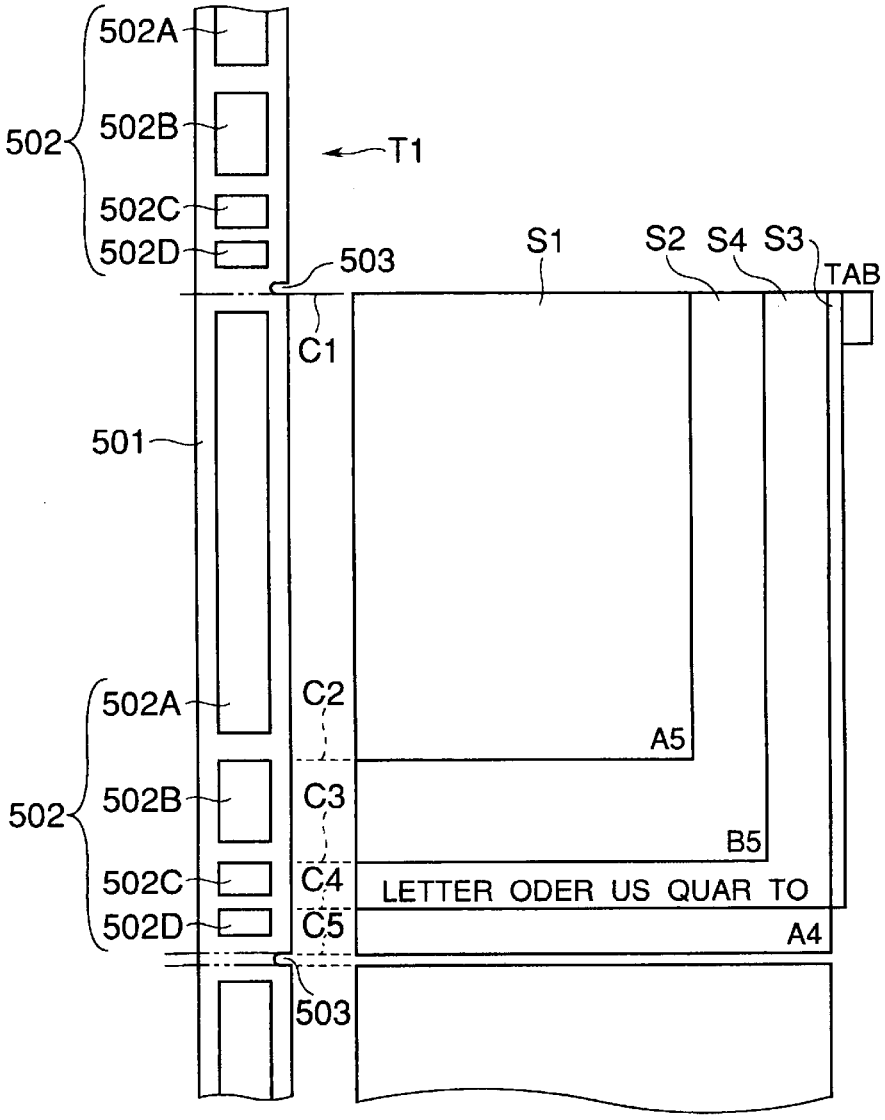
FIG. 2A is a plan view showing a relation between a block pattern on the bind tape for each bookbinding process and a size of a sheet bundle.

FIG. 2A shows a relation between the sizes of the sheet bundles and the blocks 502A–502D. Incidentally, FIG. 2B is a left side view of the bind tape T1.

When the bind tape is used to book-bind a sheet bundle S1 having A5 size (smallest size), only the largest block 502A is used. In this case, the bind tape T1 is cut at positions C1 and C2. On the other hand, when the bind tape is used to book-bind a sheet bundle S2 having B5 size (smaller size), the largest block 502A and the auxiliary block 502B are used. In this case, the bind tape T1 is cut at positions C1 and C3.

Further, when the bind tape is used to book-bind a sheet bundle S3 having Letter size (larger size), the largest block 502A and the auxiliary blocks 502B, 502C are used. In this case, the bind tape T1 is cut at positions C1 and C4. On the other hand, when the bind tape is used to book-bind a sheet bundle S4 having A4 size (largest size), the largest block 502A and the auxiliary block 502B, 502C, 502D are used. In this case, the bind tape T1 is cut at positions C1 and C5. The bind tape T1 is provided with notches (acting as marks for identifying the respective block pattern) 503 between adjacent two of which the block pattern for each bookbinding process is defined, and the cut positions C1–C5 at which the bind tape T1 are cut are calculated on the basis of the positions of the notches 503.

Figure 3:
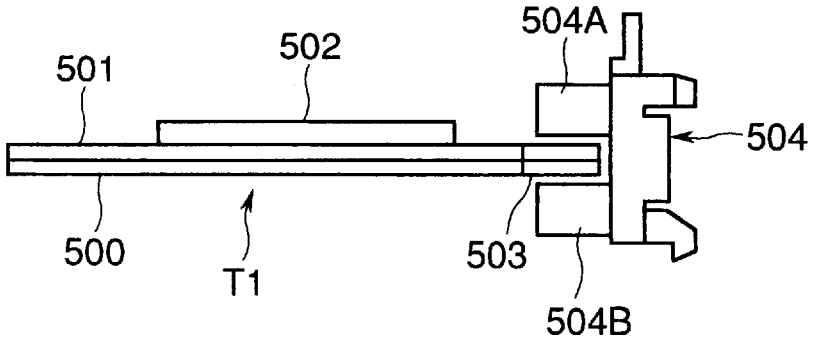
FIG. 3 is a sectional view showing an example of a detection means for detecting a notch formed in the bind tape.

FIG. 3 shows an example of a detection means for detecting the notch 503.

In this example, the notch 503 is detected by using a photo-interrupter 504. The photo-interrupter 504 is disposed at an upstream side of a cutter in a tape supplying direction in such a manner that the bind tape T1 is passed through in the photo-interrupter. When the notch 503 formed in the bind tape T1 is just passed between a light emitting portion 504A and a light receiving portion 504B of the photo-interrupter 504 as the bind tape T1 is moved, light emitted from the light emitting portion 504A reaches the light receiving portion 504B, with the result that the photo-interrupter 504 is turned ON to output a signal.

Figure 4:
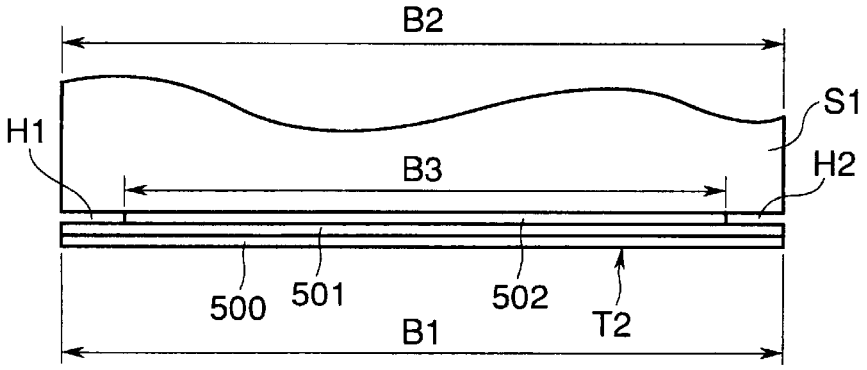
FIG. 4 is a sectional view showing a condition that the sheet bundle is glued or bonded by using a strip-shaped bind tape cut from the wound bind tape.

FIG. 4 shows a relation between the sheet bundle S1 having A5 size and a strip-shaped bind tape T2 cut to be used with the sheet bundle S2.

Although a length B1 of the bind tape T2 is equal to a length B2 of the bound edge of the sheet bundle S1, a length B3 of the thick hot melt adhesive layer 502 is slightly smaller than the length B2 of the bound edge of the sheet bundle S1. Accordingly, free areas H1, H2 on which the thick hot melt adhesive layer is not existed are formed on both lateral edge portions of the tape.

Figure 5B:
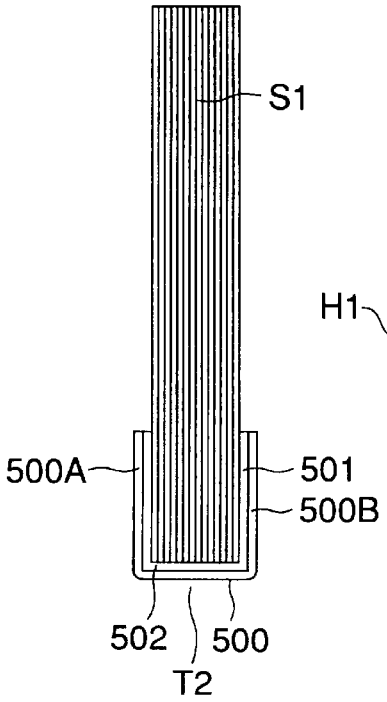
FIG. 5B is a partial front view of the sheet bundle.
Figure 5A:
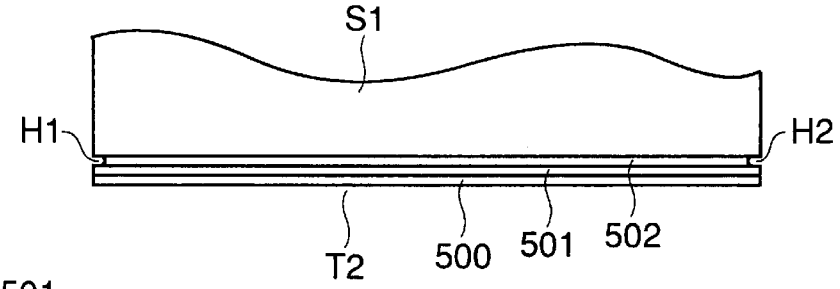
FIG. 5A is a side sectional view showing a condition that the sheet bundle is bonded by the bind tape.

Now, when the bind tape T2 is heater by a heater to melt the hot melt adhesive layer 502 and then the sheet bundle S1 is urged against the molten hot melt adhesive layer 502, although a part of the hot melt adhesive is flowed into the sheets, the other hot melt adhesive tends to be forcibly shifted by the sheet bundle S1. However, as shown in FIG. 5A, since the shifted hot melt adhesive is absorbed or received by the free areas or spaces H1, H2, the hot melt adhesive is prevented from leaking from the sheet bundle S1. Since the free spaces H1, H2 can also absorb or receive the hot melt adhesive trying to flow toward the front and back surfaces of the sheet bundle, as shown in FIG. 5B, it is possible to bent both lateral edge portions 500A, 500B of the bind tape T2 at a right angle by side heaters (not shown).

<Second Embodiment>

Figure 6B:
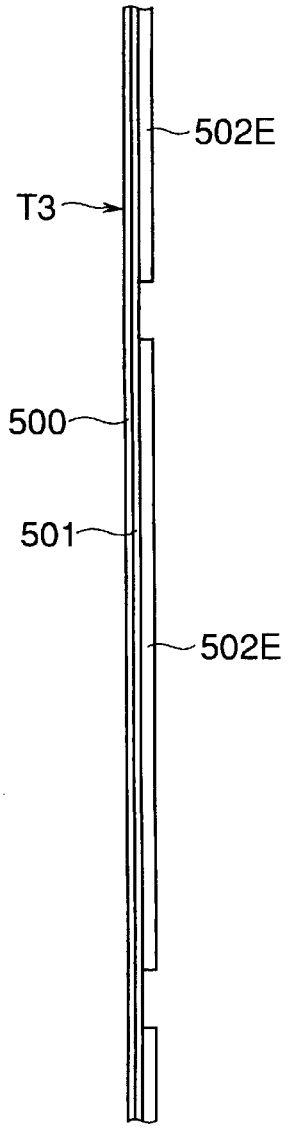
FIG. 6B is a side view showing the block pattern.
Figure 6A:
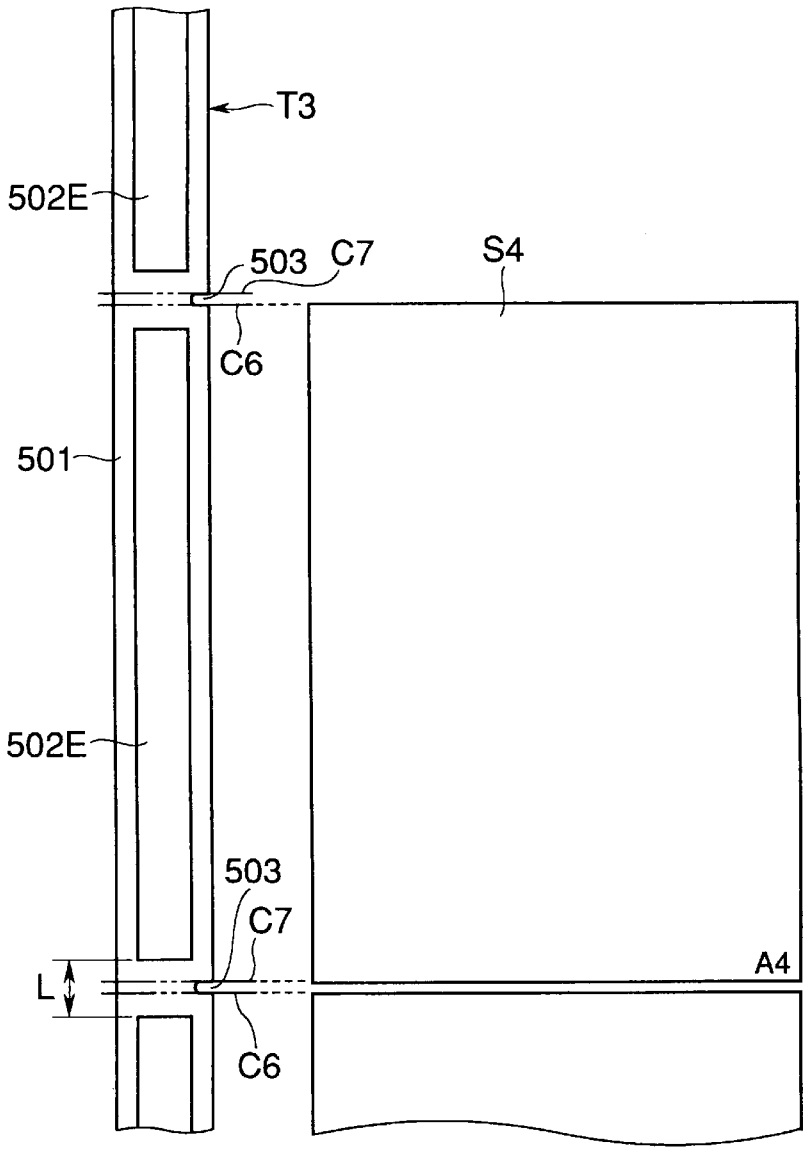
FIG. 6A is a plan view showing a relation between a block pattern on a bind tape according to a second embodiment of the present invention for each bookbinding process and a size of a sheet bundle.

In the first embodiment, while an example that the wound bind tape T1 can accommodate with the plural kinds of sheet bundles S1–S4 having different sizes was explained, in this second embodiment as shown in FIGS. 6A and 6B, a wound bind tape T3 is exclusively used for a sheet bundle having a particular size (for example, sheet bundle S4 having A4 size).

In case of the wound bind tape T3, the block pattern for each bookbinding process comprises a single block 502E, and the tape is cut at positions C6 and C7.

<Third Embodiment>

Figure 7A:
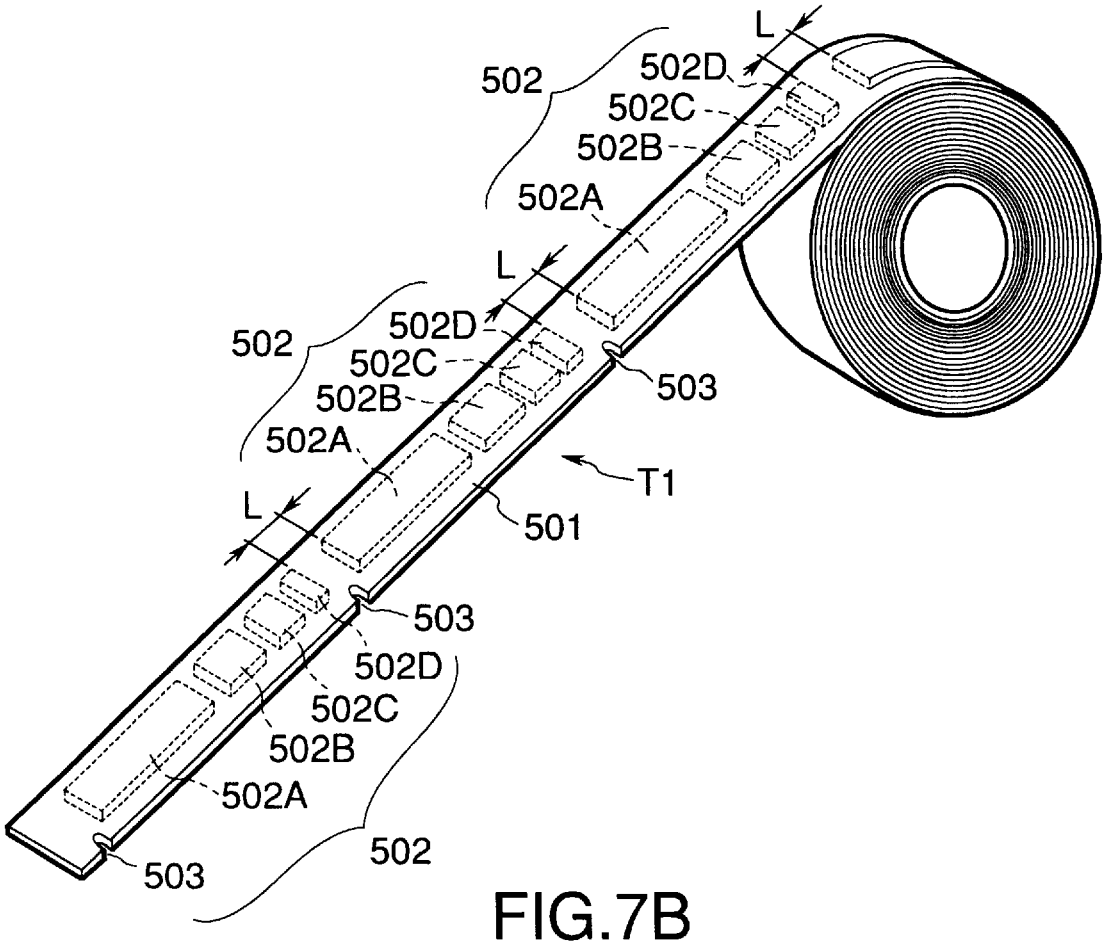
FIG. 7A is a perspective view of a wound bind tape according to a third embodiment of the present invention.
Figure 7B:
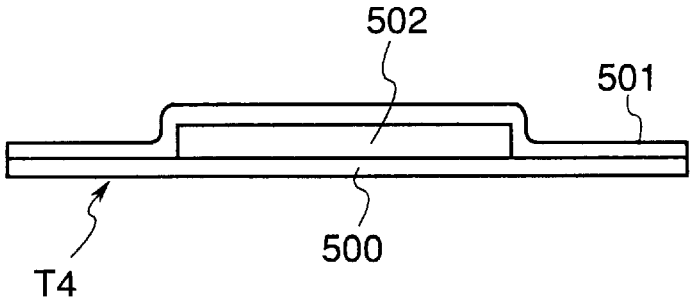
FIG. 7B is a sectional view of the bind tape.

In the first and second embodiments, while an example that the thick hot melt adhesive layer 502 is coated on the thin hot melt adhesive layer 501 in the bind tape T1 or T3 was explained, in a wound bind tape T4 according to the third embodiment as shown in FIGS. 7A and 7B, a thin hot melt adhesive layer 501 is formed to cover a thick hot melt adhesive layer 502 as shown in FIG. 6B.

The thick hot melt adhesive layer 502 of the bind tape T4 according to this embodiment is not formed by directly coating a molten hot melt adhesive on a tape substrate 500, but, a hot melt adhesive tape wound around a reel is cut to a predetermined length, and the cut adhesive tape is bond on the tape substrate 500. In this case, the hot melt adhesive tape cut to the predetermined length is bonded on the tape substrate 500, for example, by a fur-infrared ray heating means, an optical heating means, a supersonic welding means and the like.

When the thick hot melt adhesive layer 502 is formed by bonding the hot melt adhesive tape on the tape substrate 500 in this way, various advantages can be provided in comparison with the thick hot melt adhesive layer 502 formed by coating the high temperature hot melt adhesive on the tape substrate 500.

That is to say, firstly, in the manufacture of the bind tape, the property of the tape substrate 500 can be maintained. If the high temperature hot melt adhesive is coated on the tape substrate 500, moisture and gas contained in the tape substrate 500 are apt to be evaporated; whereas, when the hot melt adhesive tape is bonded on the tape substrate 500, since the moisture and gas contained in the tape substrate 500 are hard to be evaporated, the physical property of the tape substrate 500 is not deteriorated.

Secondly, a desired adhesive force of the thick hot melt adhesive layer 502 can be obtained. If the high temperature hot melt adhesive is coated on the tape substrate 500, since the gas evaporated from the tape substrate 500 creates gas bubbles in the hot melt adhesive, the thick hot melt adhesive layer 502 cannot sometimes be formed by a predetermined amount of hot melt adhesive, thereby creating the poor adhesive force; whereas, when the hot melt adhesive tape is bonded on the tape substrate 500, such poor adhesive force can be avoided.

Thirdly, the number of revolutions (windings) of the wound bind tape not insufficient. Although the number of windings of the wound bind tape is checked by an outer diameter of the wound tape roll, if the high temperature hot melt adhesive is coated on the tape substrate 500, since the gas evaporated from the tape substrate 500 creates gas bubbles in the hot melt adhesive, the thick hot melt adhesive layer 502 is swollen, the number of windings of the wound bind tape sometimes becomes insufficient. To the contrary, when the hot melt adhesive tape is bonded on the tape substrate 500, since the thick hot melt adhesive layer 502 is swollen, the number of windings of the wound bind tape does not become insufficient.

For example, by forming aluminium foil on the surface of the tape substrate 500, the moisture and/or gas can be prevented from being evaporated from the tape substrate 500. However, in this case, the bind tape becomes more expensive.

Further, as is in the wound bind tape T4 according to this embodiment, when the thin hot melt adhesive layer 501 is formed on the thick hot melt adhesive layer 502 bonded on the tape substrate 500, since the thick hot melt adhesive layer 502 is covered by the thin hot melt adhesive layer 501, (1) the evaporation of the moisture/gas from the thick hot melt adhesive layer 502 can be suppressed when the tape is heated by the heater, (2) in the bind tape wound in the roll form, since the thick hot melt adhesive layer 502 is not directly contacted with the tape substrate 500, the blocking does not occur even when the wound bind tape is stored for a long time, and (3) since the thick hot melt adhesive layer 502 is stabilized even when the melting point temperature thereof is decreased, the heating time of the heater can be reduced, with the result that the productivity of the on-line system can be improved.

<Example of Wound Bind Tape Manufacturing Apparatus>

Figure 8:
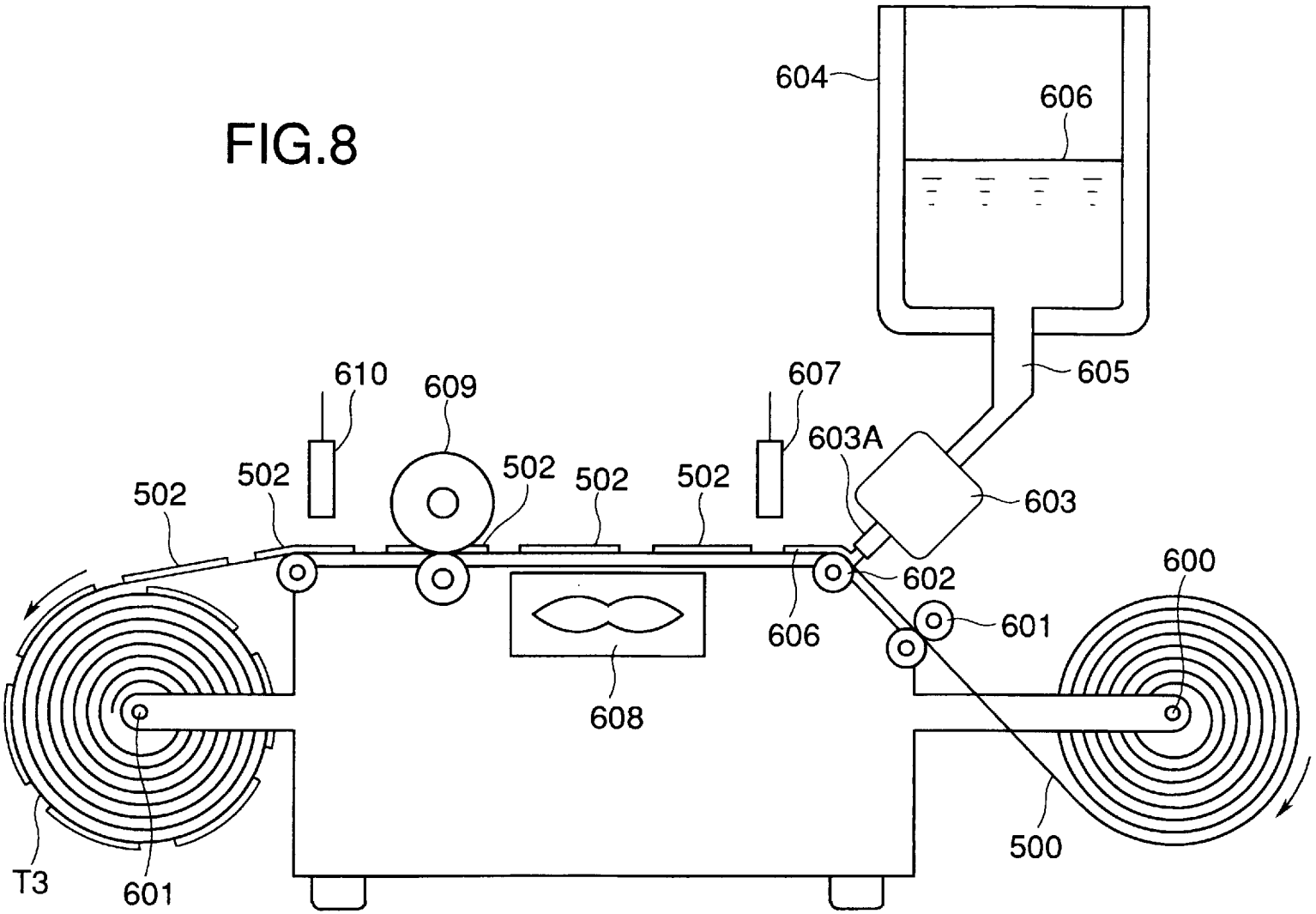
FIG. 8 is an elevational view of a bind tape manufacturing apparatus for manufacturing the wound bind tape according to the present invention.

FIG. 8 shows an example of an apparatus for manufacturing the wound bind tape T1 according to the first embodiment.

The tape substrate 500 on the surface of which the thin hot melt adhesive layer 501 was entirely coated is wound in the roll form which is supported on a support shaft 600. The tape substrate 500 is fed out by a pair of feed rollers 601 to be conveyed to a convey roller 602. When the tape substrate 500 is being passed through the convey roller 602, hot melt adhesive 606 injected (by a metering amount) from a discharge nozzle 603A of a metering injector 603 is coated on the thin hot melt adhesive layer 501, thereby successively forming the thick hot melt adhesive layers 502 as the block patterns for respective bookbinding processes.

The molten hot melt adhesive 606 is supplied from a hopper 604 including a heater to the metering injector 603 through a supply path 605. Further, since the metering injector 603 has a function for sucking the threaded hot melt adhesive 606 from the discharge nozzle 603A after a valve is closed, the edge accuracy, volume accuracy and dimension accuracy of the thick hot melt adhesive layers 502 formed on the tape substrate 500 can be maintained to the desired values.

Incidentally, the timing for injecting the hot melt adhesive 606 from the metering injector 603 is set on the basis of detection information from an optical detection means 607. That is to say, when a notch 503 formed in the tape substrate 500 being moved is detected by the optical detection means 607, the hot melt adhesive 606 is appropriately injected from the metering injector 603 in accordance with the block patterns.

The hot melt adhesive 606 coated on the tape substrate 500 is forcibly cooled by a cooling fan 608 to be quickly solidified, thereby forming the stabilized adhesive layers. Then, both lateral edges of the tape substrate 500 are cut off by a slitter device 609. Then, after the tape is checked by a checking detection means 610, the tape is wound around a take-up shaft 611.

<Example of Bind Tape Supplying Apparatus>

Figure 9:
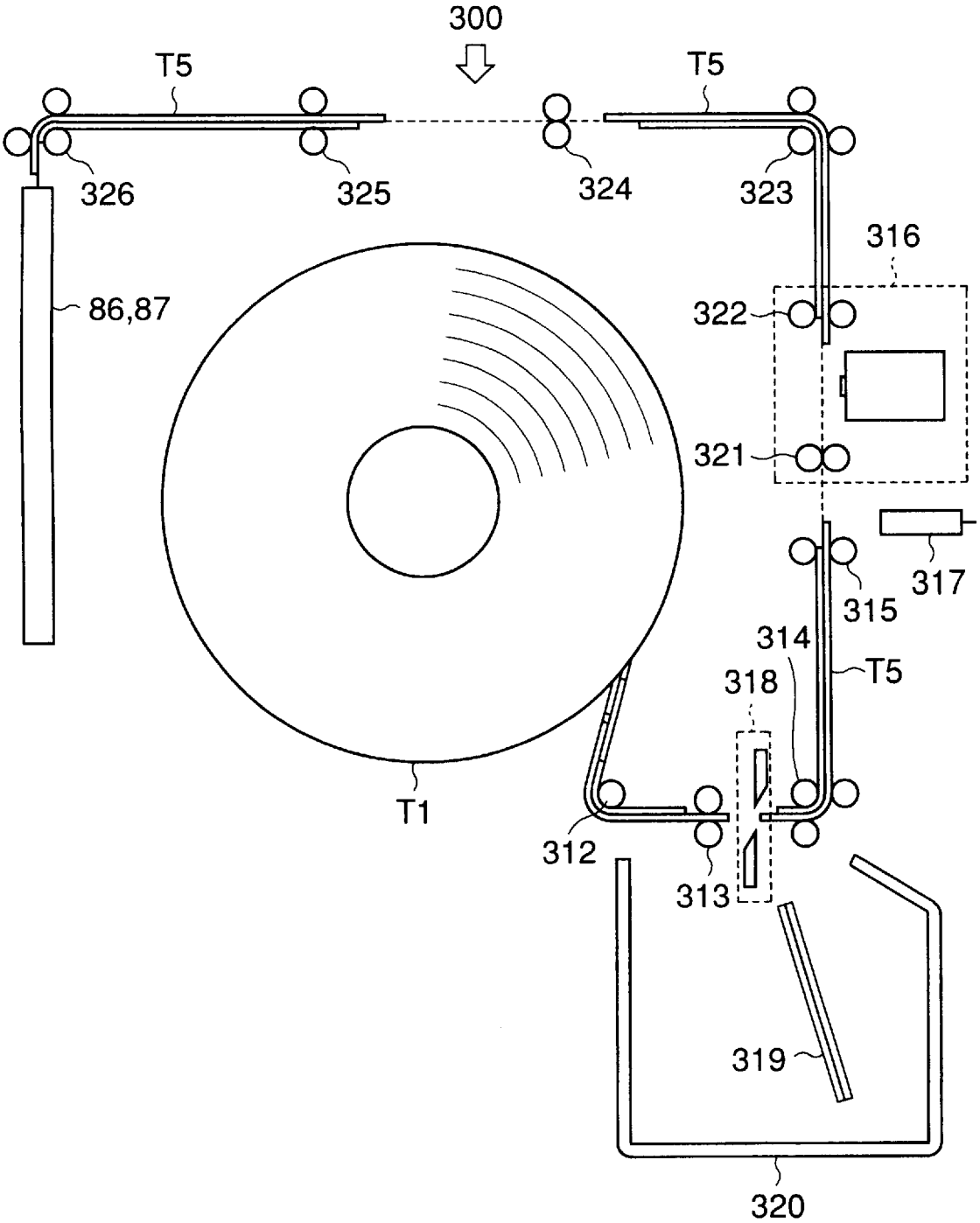
FIG. 9 is a sectional view of a bind tape supplying apparatus for cutting the wound bind tape of the present invention into a strip-shaped bind tape and for supplying the strip-shaped bind tape to a bookbinding position.

FIG. 9 shows an apparatus (bind tape supplying apparatus) 300 for cutting the bind tape T1 according to the first embodiment in a strip-shape and for supplying the strip-shaped bind tape to a bookbinding position.

The wound bind tape T1 rotatably supported at a predetermined position is guided by a guide roller 312 and conveyed by convey rollers 313, 314, 315 to reach a printing device 316. In this case, when a cut reference position C6 is determined by detecting the notch 503 by means of an optical detection means (photo-interrupter) 317, a cutting device 318 is operated to cut the bind tape T1 at a cutting position C7. A non-used (waste) tape portion 319 generate by the cutting is dropped into a dust box 320.

After the cutting, while the strip-shaped bind tape T5 is being passed through the ink jet printing device 316 by means of convey rollers 321, 322, "title" and the like are printed on the bind tape. After the printing, the bind tape T5 is sent to the bookbinding position (tape guides 86, 87 for heaters 51, 52 in FIGS. 20A and 20B) by convey rollers 323, 324, 325, 326.

Incidentally, the markings for defining or delimiting the block pattern for each bookbinding process in the bind tapes T1, T3, T4 are not limited to the notches 503. For example, such markings may be formed from light reflecting members or light reflecting coatings which can be detected by the optical detection means. Further, the markings may be formed from magnetic members or non-magnetic members which can be detected by a magnetic detection means. Alternatively, the markings may be constituted by holes (including notches) which can be detected by a mechanical detection means.

Although such markings are used for detecting the position in the manufacture of the bind tape and the position in the supply of the bind tape and for checking the remaining amount of the bind tape, in the manufacture of the bind tape, since the bind tape is in the elevated temperature condition, it is preferable that the optical or magnetic detection means capable of detecting the position without contacting with the high temperature bind tape is used.

Next, another embodiment of a bind tape supplying apparatus and another example of a bind tape cutting method will be explained with reference to FIGS. 10 to 13C.

Figure 10:
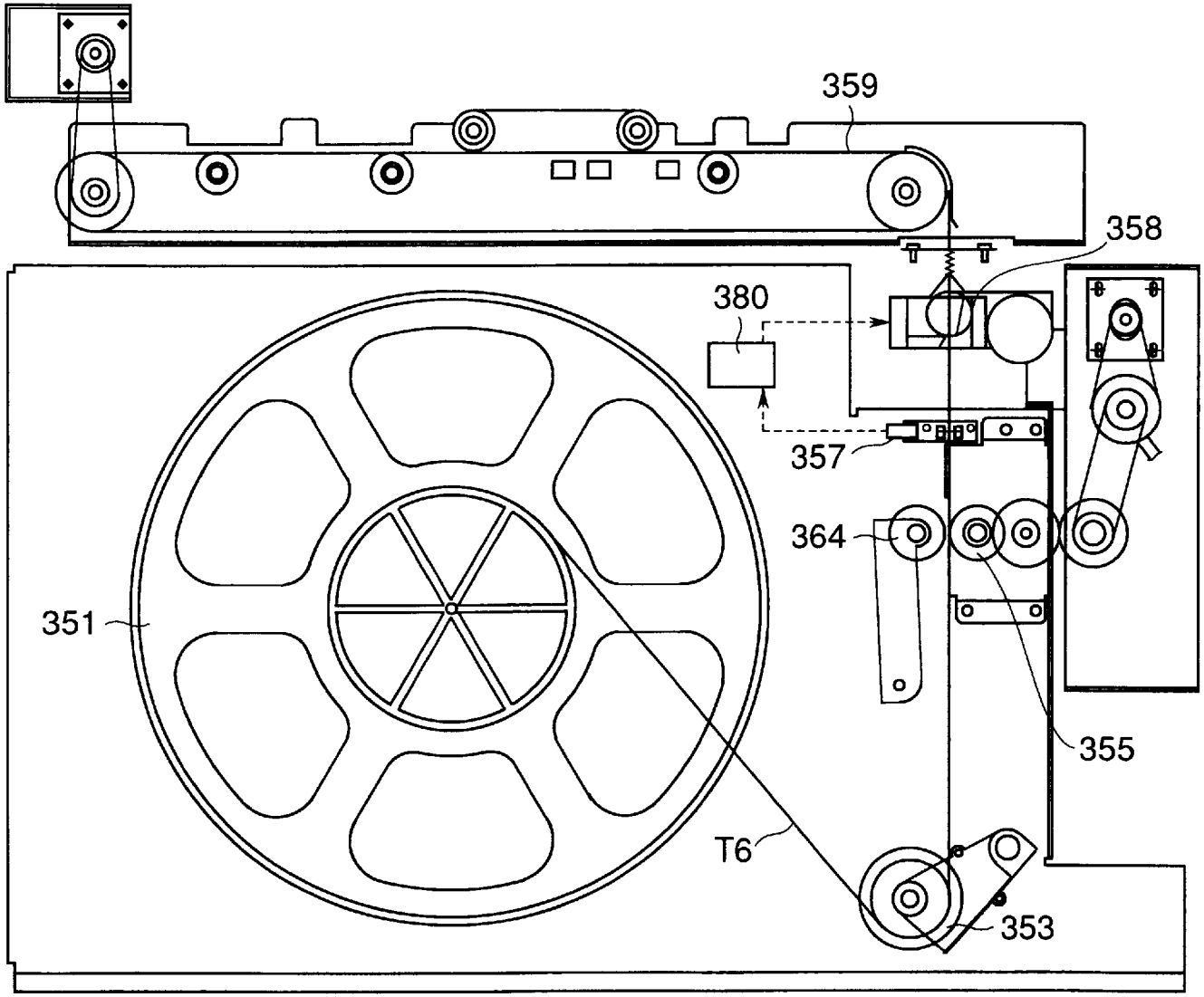
FIG. 10 is a sectional view showing another example of a bind tape supplying apparatus for supplying the bind tape of the present invention.

FIG. 10 is a plan view showing a tape reel 351 (77A, 77B) and its convey system in detail. In FIG. 10, a gluing tape T6 wound around a tape reel (gluing tape containing portion) 351 is conveyed through a tensioner 353 to a gluing tape convey means (drive roller 355 and pinch roller 364) where the gluing tape is pinched between the drive roller 355 and the pinch roller 364. The reference numeral 356 denotes a driving pulse motor for a tape feed-out portion. A tip end of the gluing tape T6 is so set that the tip end is positioned in front of a tape tip end detection sensor 357 by a distance corresponding to a predetermined number of pulses of the pulse motor. In the bookbinding operation, in order to supply the gluing tape T6 to the back of the sheet bundle, it is necessary to correctly cut the tape in accordance with a length of the back of the sheet bundle. In FIG. 10, after the tape conveyance is started, from the time when the tip end of the tape is detected by the tape tip end detection sensor 357, a distance up to a cut portion and (plus) a convey amount of tape corresponding to the length of the sheet bundle are controlled by the number of pulses of the tape driving pulse motor 356. After the gluing tape T6 is conveyed by the drive roller 355 by a distance corresponding to the predetermined number of pulses, the tape is cut by a cutter (tape cut means) 358, and the cut gluing tape T6 is transferred to a further convey means 359 for conveying the tape to the back of the sheet bundle. Further, the remaining gluing tape T6 extending to the tape reel 351 is returned to the initial position by rotating the driving pulse motor 356 in a reverse direction, thereby preparing a next cutting operation.

Incidentally, the reference numeral 380 denotes a control means for controlling the cutter 358 on the basis of a detected result of the detection sensor 357.

FIGS. 11A and 11B show the details of the gluing tape T6. In FIGS. 11A and 11B, the reference numeral 553 denotes a tape substrate; 570, 571, 572 denote cut position detecting markings provided on the tape substrate 553; and 583 denotes phantom lines indicating cut positions corresponding to the markings. Positional relations w between the positions of the markings 570, 571, 572 and the cut positions 583 are the same as the actual positional relation between the photo-interrupter and the cutting position of the cutter. The reference numerals 577, 578, 579 denote traces of the detection positions on the tape detected by the photo-interrupter fixed to a convey system (not shown) during the conveyance of the tape. Further, a hatched portion H indicates a tape portion already cut. The reference numeral 554 denotes the thick hot melt adhesive layers which are predetermined tape with predetermined block patterns.

In FIG. 11A, when the gluing tape T6 is conveyed from a tape tip end position A in a convey direction shown by the arrow, signals can be obtained by the markings 570, 571, 572 corresponding to sheet size positions B, C, D. By counting the pulses of the signal, the desired cut size position can be detected. Further, as shown in FIG. 11B, the cut size position (cut position) may be detected by using two sensors and by combining output signal levels (FIG. 11C) from the photo-interrupters when the gluing tape is conveyed.

Figure 12A:
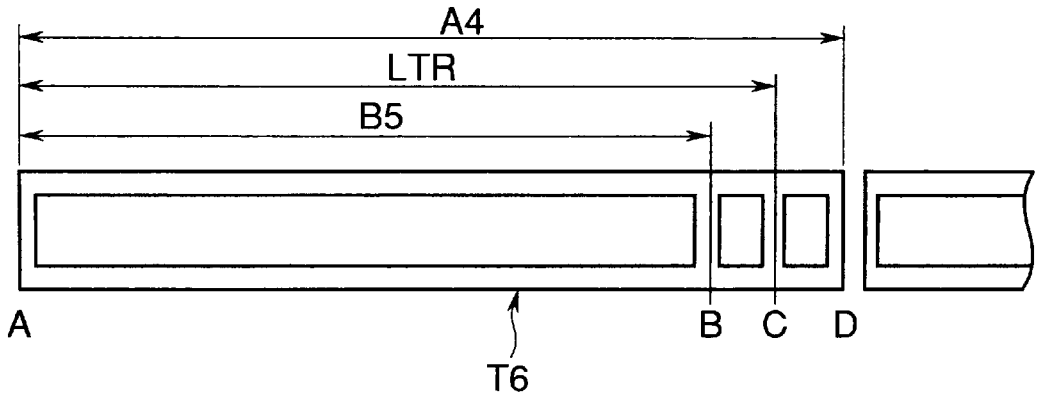
FIGS. 12A to 12C are views showing cut conditions of the bind tape of the present invention.
Figure 12B:
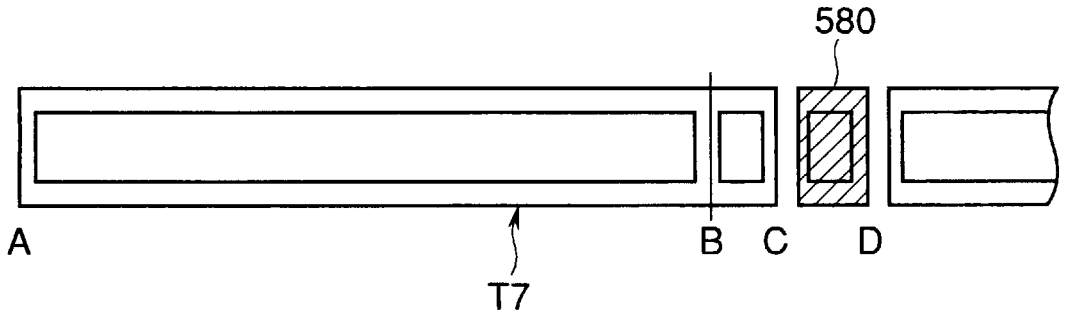
Figure 12C:
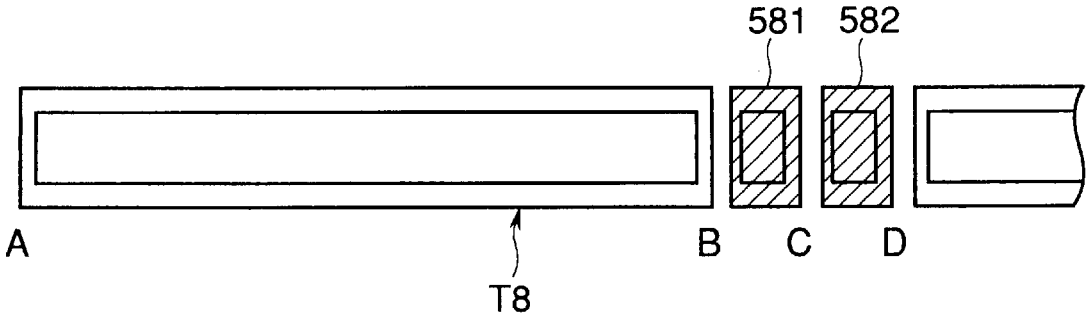

A method for cutting the tape on the basis of the signal regarding the detected cut size position is shown in FIGS. 12A, 12B and 12C. The detected cut size position signal is sent to the control means 380. In FIGS. 12A, 12B and 12C, when the gluing of the sheet bundle having A4 size is selected, as shown in FIG. 12A, the tape T6 is conveyed up to the position D with the tip end A going ahead, and the tape is cut at the position D by the cutter 358 controlled by the control means 380. In this case, the tape end (at D) of the remaining tape connected to the tape reel becomes a tip end of the next tape.

When the gluing of the sheet bundle having Letter size is selected, as shown in FIG. 12B, the tape is conveyed up to the position C, where the tape is cut. The cut tape T7 is conveyed to the further convey system, and, at the same time, the remaining tape is further conveyed up to the position D and then is cut. In this case, a tape piece 580 cut between the positions C–D is dropped downwardly by its own weight to be collected or contained in a tape containing portion (not shown). Further, the tape end (at D) of the remaining tape connected to the tape reel becomes a tip end of the next tape.

When the gluing of the sheet bundle having B5 size is selected, as shown in FIG. 12C, the tape is conveyed up to the position B, where the tape is cut. The cut tape T8 is conveyed to the further convey system, and, at the same time, the remaining tape is further conveyed up to the position C and then is cut. Then, the remaining tape is further conveyed up to the position D and then is cut. In this case, tape pieces 581, 582 cut between the positions B–C, C–D are dropped downwardly by their own weights to be collected or contained in the tape containing portion (not shown). Further, the tape end (at D) of the remaining tape connected to the tape reel becomes a tip end of the next tape.

In this way, even when the sheet bundle having the smallest size is selected, the tape is cut at all of the tape size positions existed between the largest tape length, it is possible to prevent the longer tape from being caught or trapped in the cutter. Further, since the tape to be supplied is cut on the way, a distance that the cut tape is conveyed to the inlet of the further convey path can be shortened, thereby providing the stable transferring of the tape.

Next, an alteration will be explained. Incidentally, the same elements as those in the above-mentioned embodiment are designated by the same reference numerals and explanation thereof will be omitted.

In the above-mentioned embodiment, in the case where the tape is cut to a size smaller than the largest size, if any other cut position is detected until the tip end of the next tape is cut, the tape is also cut at the detected cut position. In this case, in the method wherein the tape pieces discharged from the cutter portion are made small, although the tape pieces can smoothly be discharged from the cutter, since the tape pieces are stacked in the tape piece containing portion at random, excessive spaces will be created between the tape pieces as the tape pieces are badly overlapped, thereby reducing the tape containing ability of the tape piece containing portion.

Figures 13A, 13B, 13C:
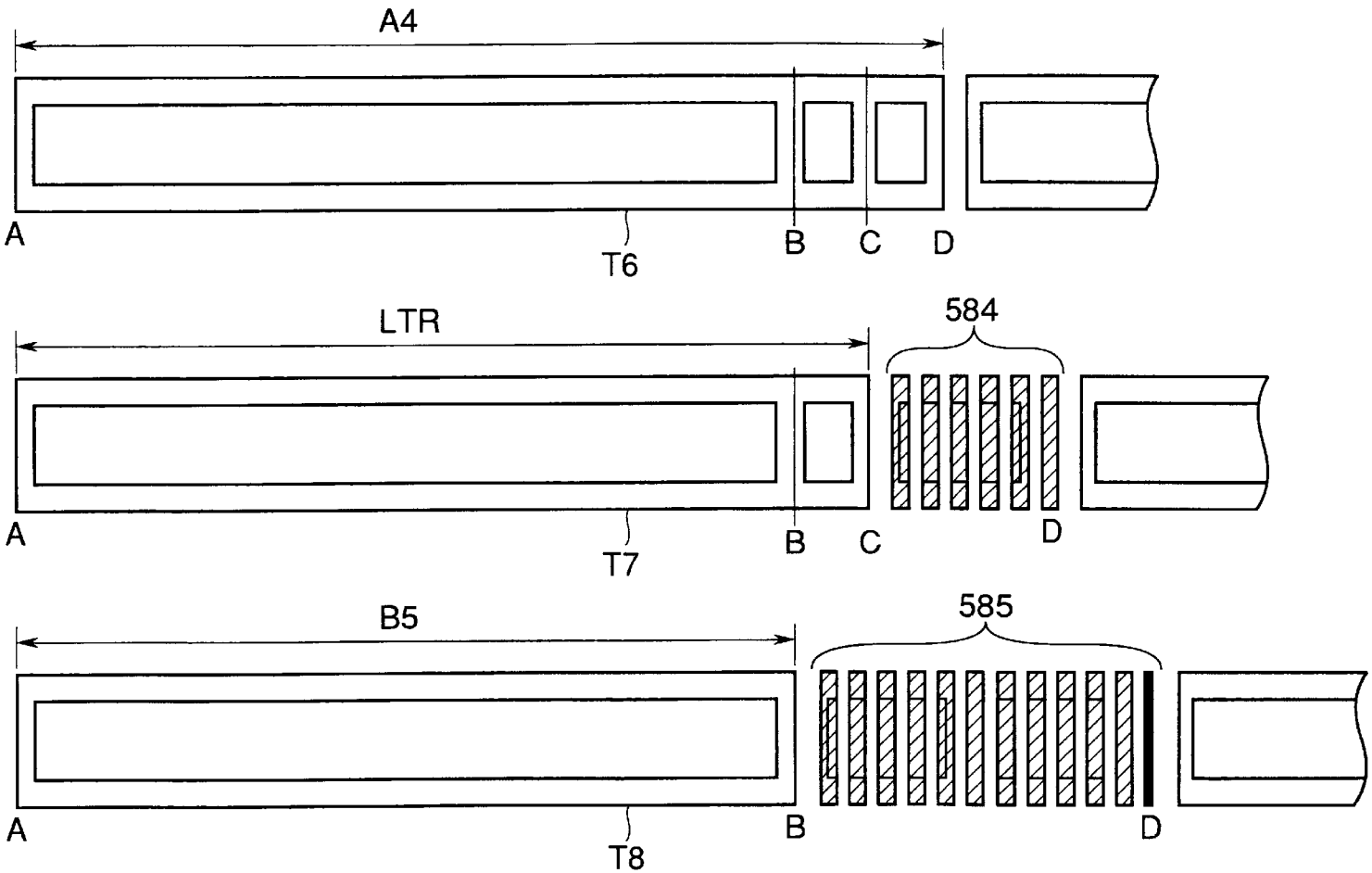
FIGS. 13A to 13C are views showing another example of cut conditions of the bind tape of the present invention.

In FIGS. 13A to 13C, when the bind tape for the sheet bundle having A4 size is selected, as shown in FIG. 13A, the tape is conveyed up to the position D with the tip end A going ahead. In this case, the tape end (cut at D) of the remaining tape connected to the tape reel becomes a tip end of the next tape.

When the bind tape for the sheet bundle having Letter size is selected, as shown in FIG. 13A, the tape is conveyed up to the position C, where the tape is cut. The cut tape T7 is conveyed to the further convey system, and, at the same time, the remaining tape is intermittently conveyed by a predetermined small distance and successively cut by the cutter as shown until the signal corresponding to the cut position D is detected. The cut small tape pieces 584 are successively stacked in the tape piece containing portion disposed below the cutter. When the signal corresponding to the cut position D is detected, the conveyance of the tape is stopped, and the tape is further cut at the position D, thereby creating the tip end for the next tape.

When the bind tape for the sheet bundle having B5 size is selected, as shown in FIG. 13C, the tape is conveyed up to the position B, where the tape is cut. The cut gluing tape T8 is conveyed to the further convey system, and, at the same time, the remaining tape is intermittently conveyed by a predetermined small distance and successively cut by the cutter as shown until the signal corresponding to the cut position D is detected. The cut small tape pieces 585 are successively stacked in the tape piece containing portion disposed below the cutter. When the signal corresponding to the cut position D is detected, the conveyance of the tape is stopped, and the tape is further cut at the position D, thereby creating the tip end for the next tape.

Since the tape is successively cut to form smaller tape pieces, when the tape pieces are stacked in the tape piece containing portion, the excessive spaces are not created between the small tape pieces even if the tape pieces are badly overlapped, thereby providing the efficient tape containing ability of the tape containing portion. Further, since the tape pieces are cut to have small lengths, the distance that the tape cut to the required length is conveyed to the inlet of the further convey path can be shortened, thereby providing the more positive transferring of the tape and shortening the convey path.

<On-line System>

Figure 14:
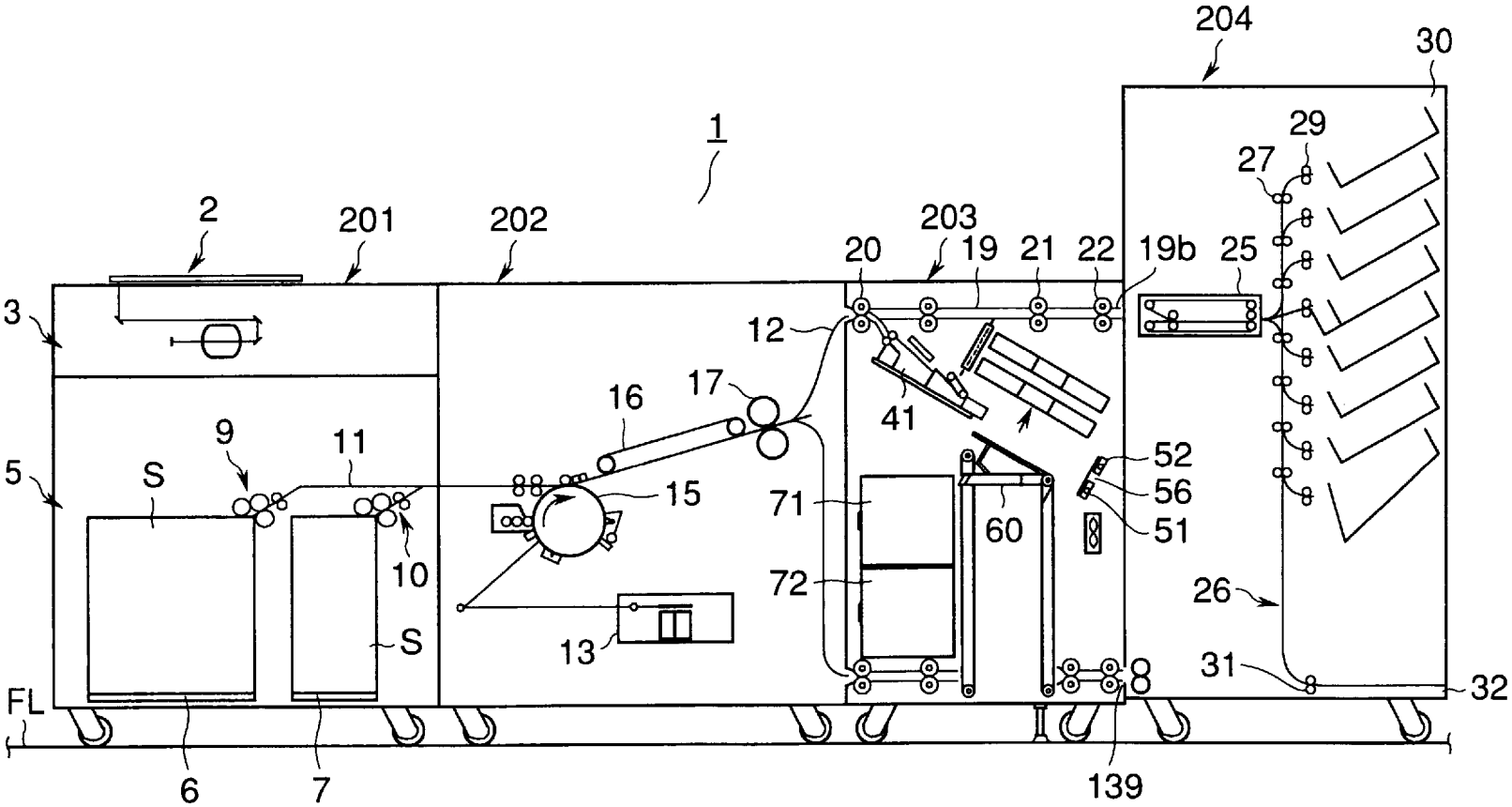
FIG. 14 is an elevational sectional view of an on-line system in which the bookbinding is performed by using the wound bind tape of the present invention.

FIG. 14 shows the on-line system in which the sheet bundle S1 is book-bound by using the wound bind tape T (T1, T3, T4, T6).

The on-line system 1 comprises a reading/sheet supplying apparatus 201, an image forming apparatus 202, a bookbinding apparatus 203, and a sorting and containing apparatus 204 which are connected to each other in series. The reading/sheet supplying apparatus 201 is provided at its upper portion with an original support portion 2 on which originals (not shown) are set, and an optical system 3 for reading and scanning the original, and is also provided at its lower portion with a plurality of sheet supply decks 6, 7 on which sheets S having different sizes are stacked, and sheet supply portions 9, 10 for supplying the sheet S.

The supplied sheet S is conveyed to a sheet convey path 12 of the image forming apparatus 202 (disposed at a downstream side of the apparatus 201) through a sheet convey portion 11. The reference numeral 13 denotes a laser scanner for emitting laser light on the basis of image information read by the optical system 3; and 15 denotes an image forming portion (photosensitive drum) on which a toner image is formed. The sheet S on which an image was formed in the image forming portion 15 is conveyed to a sheet convey path 19 of the bookbinding apparatus 203 (disposed at a downstream side of the apparatus 202) through a convey belt 16 and a pair of fixing rollers 17.

The bookbinding apparatus 203 includes a sheet alignment tray 41 for receiving aligning the sheets S branched and conveyed from the sheet convey path 19, an abutment member 59 against which tip ends of the sheets abut, a tape heating device 56 for heating the aligned sheet bundle and the bind tape, a vertically movable carriage 60 having a handling member 805 for handling the book-bound sheet bundle, and stackers 71, 72 for containing the book-bound sheet bundles.

In the sorting and containing apparatus 204, the reference numeral 25 denotes an elevator for transferring the sheet S sent from the sheet convey path 19 to a convey path 26; 27 denotes pairs of convey rollers disposed at a plurality of branched portions of the convey path 26; and 29 denotes pairs of discharge rollers for discharging the sheets S branched by the respective branched portions into respective discharge trays 30. Further, the book-bound sheet bundle discharged from a discharge opening 139 of the bookbinding apparatus 203 is discharged out of the on-line system via the elevator 25 and a pair of convey rollers 31 through a discharge opening 32.

Incidentally, when the bookbinding apparatus 203 is not connected to the sorting and containing apparatus 204, the bookbinding apparatus 203 may comprise a stacking tray (not shown) on which the sheets discharged through a first discharge opening 19*b* are stacked, and a stacking tray (not shown) on which the book-bound sheet bundles discharged through the second discharge opening 139 are stacked.

Figure 15:
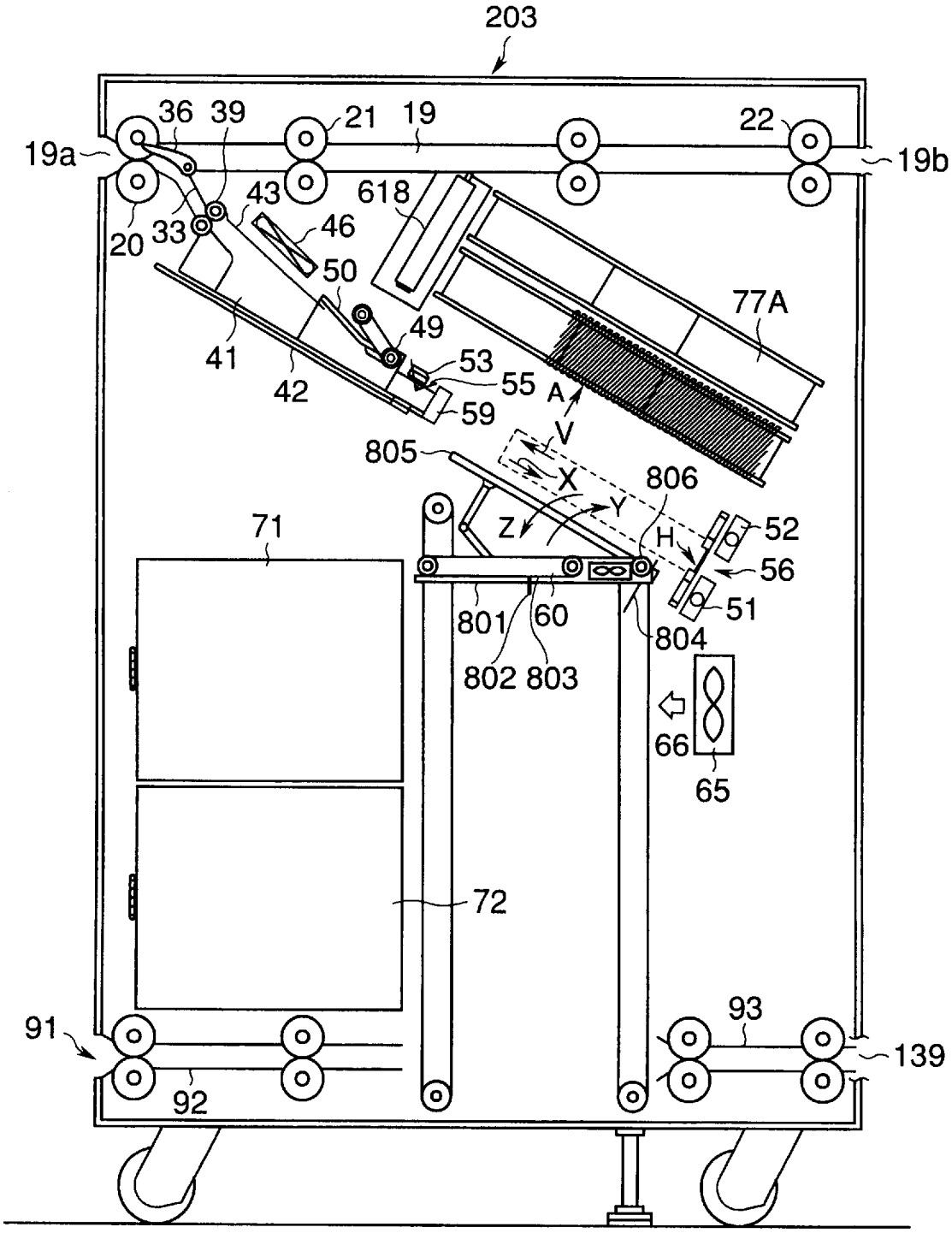
FIG. 15 is an elevational sectional view of a bookbinding apparatus of the on-line system of FIG. 14.

FIG. 15 shows the details of the bookbinding apparatus 203.

The bookbinding apparatus 203 has the sheet convey path 19 for the sheet conveyed from the image forming apparatus 202, which sheet convey path is provided at its both ends with a first inlet opening 19*a* and the first discharge opening 19*b*, respectively. Along the sheet convey path 19, there are disposed a pair of inlet rollers 20, pairs of convey rollers 21 and a pair of discharge rollers 22, from an upstream side to a downstream side in the sheet convey direction. A flapper 36 is disposed at a downstream side of and in the vicinity of the pair of inlet rollers 20, which flapper serves to switch a sheet path between the sheet convey path 19 and a guide path 33. When the flapper 36 is operated, the sheet is directed to the guide path 33; whereas, when the flapper is not operated, the sheet is directed to the sheet convey path 19.

At a downstream side of the guide path 33, there is disposed a sheet alignment tray 41 having an upper guide plate 43. The tray is inclined so that a downstream end (free end) thereof becomes lower than an upstream end thereof, and is provided at its free end with an abutment member 59 against which the sheets S can abut. The sheets introduced onto the sheet alignment tray 41 by means of a pair of convey roller 39 are shifted toward the abutment member 59 by a sweeping member 49 comprised of a belt rockable around an upper end thereof, so that the sheets abut against the abutment member 59 to be aligned with each other. Further, the alignment of the sheets in a widthwise direction is effected by abutting the sheets against a side reference member (not shown) by means of a lateral sweeping member 50. A fan 46 disposed above the upper guide plate 43 serves to urge the sheets S against the alignment tray 41 by the action of air, thereby preventing the stacked sheets S or the folded sheet S from swelling.

The reference numeral 53 denotes a clamp member for clamping the sheet bundle having a predetermined number of sheets; 42 denotes an auxiliary guide plate for the sheet bundle; and 55 denotes a stop finger (which is operated when several sheet bundles corresponding to one book is received, thereby temporarily storing several sheets in the next sheet bundle). Further, the carriage 60 for shifting the book-bound sheet bundle has the following construction.

That is to say, the carriage 60 comprises a housing 801 supported by a rotatable chain and the like for shifting movement in a vertical direction, a reversibly rotatable convey belt 803 provided on the housing 801, a pushing member 802 shiftable together with the convey belt 803, a sheet bundle trail end supporting plate 804 against which a trail end of the sheet bundle guided by the auxiliary guide plate 42 can abut and which can be shifted between a position where the sheet bundle abuts against the plate 804 (i.e. position for supporting the sheet bundle) and a retard position (where the sheet bundle cannot abut against the plate), and a sheet bundle supporting bar 805 supported by a link 807 shiftable between a position where the book-bound sheet bundle is received and a position where the sheet bundle is transferred to the belt 803. The supporting bar 805 is pivotally mounted on a support shaft 806.

When the sheet bundle S1 is separated from the tape heating device 56 by the clamp member 53, the sheet bundle trail end supporting plate 804 is shifted to the position for supporting the sheet bundle, with the result that, when the sheet bundle S1 is disengaged from the clamp member 53, the sheet bundle abuts against the supporting plate 804 and is supported by the latter. The bind tape T supplied (unwound) from a first tape reel 77A or a second tape reel 77B is cut by a cutter 618 to a predetermined length.

In FIG. 15, a fan 65 serves to cool the book-bound sheet bundle by flowing air toward a direction shown by the arrow 66. The stackers 71, 72 for containing the book-bound sheet bundles conveyed by the carriage 60 are retractably guided by guide rails 70. The construction and operation of the apparatus 630 (refer to FIGS. 9 and 10) for supplying the wound bind tape T from the tape reel 77A or 77B are as follows.

FIGS. 16 to 19 show conditions that the sheets S are introduced onto the sheet alignment tray 41 and that the back of the sheet bundle S1 is shifted to a back abutment position H.

Figure 16:
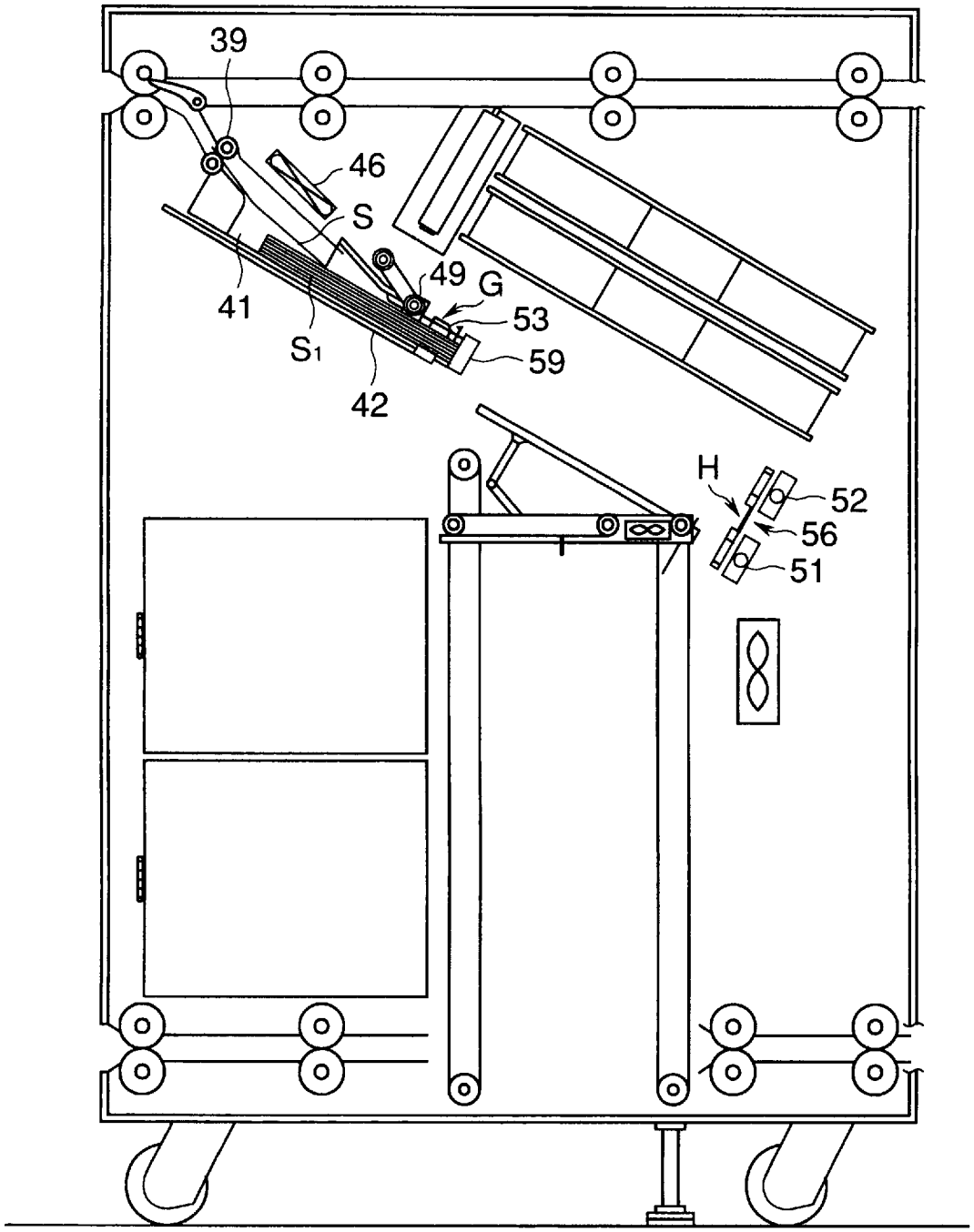
FIG. 16 is an elevational sectional view of the bookbinding apparatus showing a condition that sheets are aligned with each other on an alignment tray.

In FIG. 16, when the sheets corresponding to the sheet bundle S1 for one book are introduced onto the sheet alignment tray 41 and the sheets are aligned with each other, the clamp member 53 is operated in a direction shown by the arrow G to clamp the sheet bundle S1. When a plural sheet bundles are book-bound, in synchronous with the operation of the clamp member, the stop finger 55 is operated to temporarily store several sheets S in the next sheet bundle until the aligned sheet bundle S1 clamped by the clamp member 53 is conveyed out of the alignment tray 41.

Figure 17:
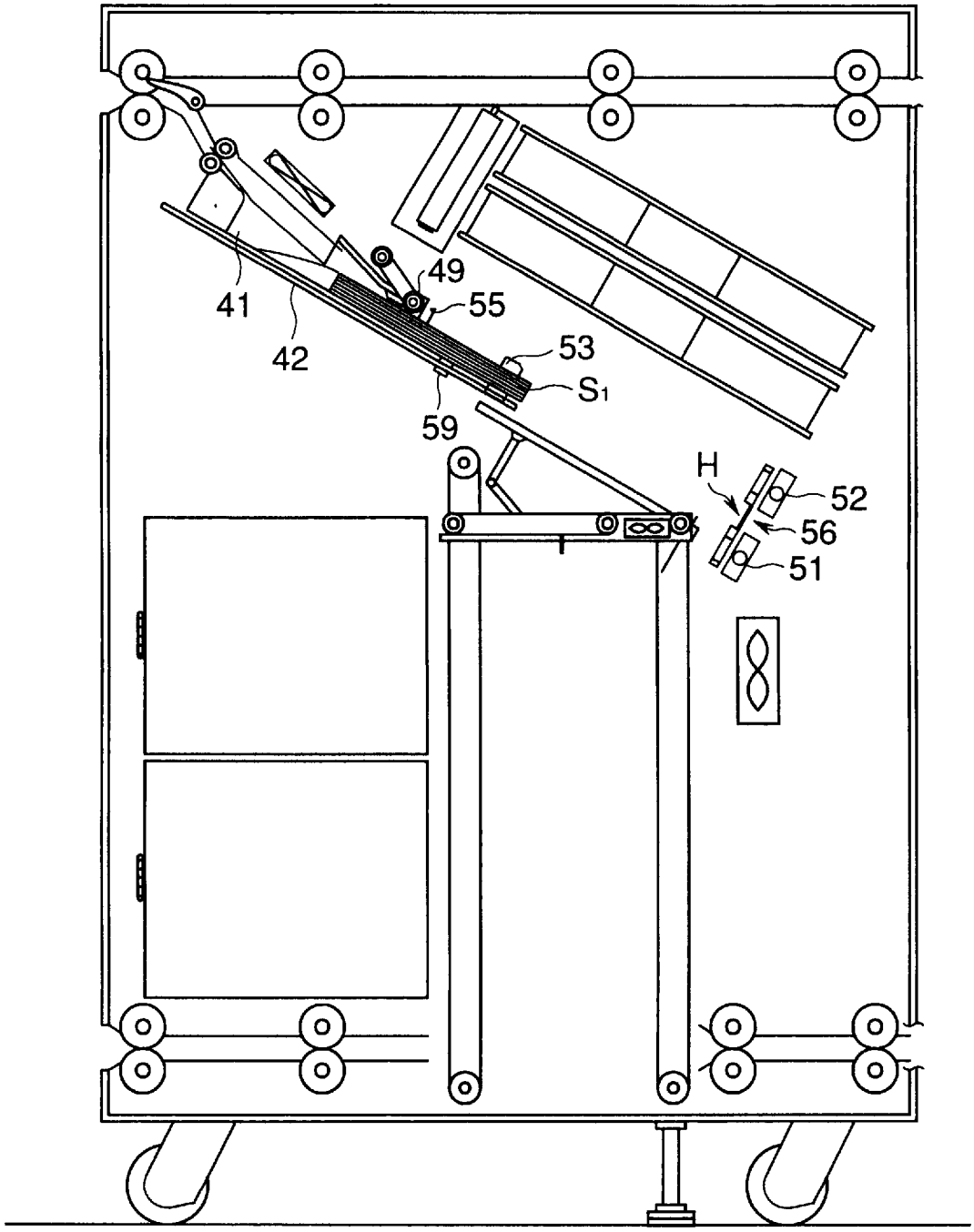
FIGS. 17 to 19 are elevational sectional views of the bookbinding apparatus, for explaining an operation for shifting the sheet bundle aligned on the alignment tray toward a back side of a heater.

FIG. 17 shows a condition that the abutment member 59 is retarded to the retard position and the sheet bundle S1 is being conveyed by the clamp member 53 from the alignment tray 41 toward the back abutment position H. The clamp member 53 clamping the sheet bundle S1 is linearly shifted toward the back abutment position H (without applying excessive stress to the sheet bundle S1). In this case, substantially, in synchronous with the shifting movement of the clamp member 53, the auxiliary guide plate 42 is shifted from below the alignment tray 41 to the vicinity of the back abutment position H in parallel with the moving sheet bundle S1 at substantially the same speed as the latter, thereby guiding the lower surface of the sheet bundle S1.

Figure 18:
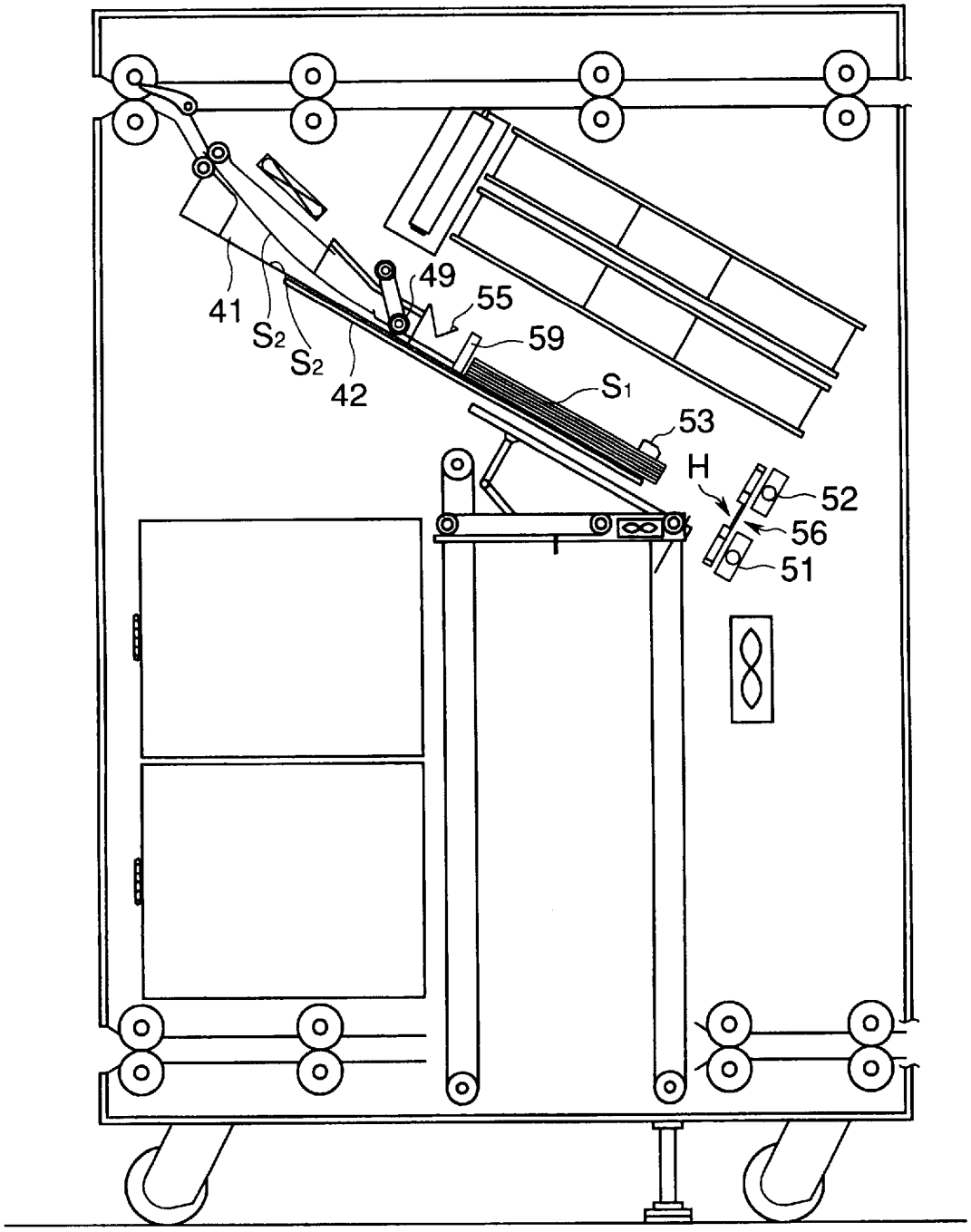

FIG. 18 shows a condition that the sheet bundle S1 is discharged out of the alignment tray 41 by means of the clamp member 53. When the sheet bundle S1 is discharged out of the alignment tray 41 by means of the clamp member 53, the abutment member 59 is returned to the abutment position, and the stop finger 55 is retarded from the storing position to the retard position, thereby storing several sheets S2 on the alignment tray 41 and aligning the sheets S2 with each other.

Figure 19:
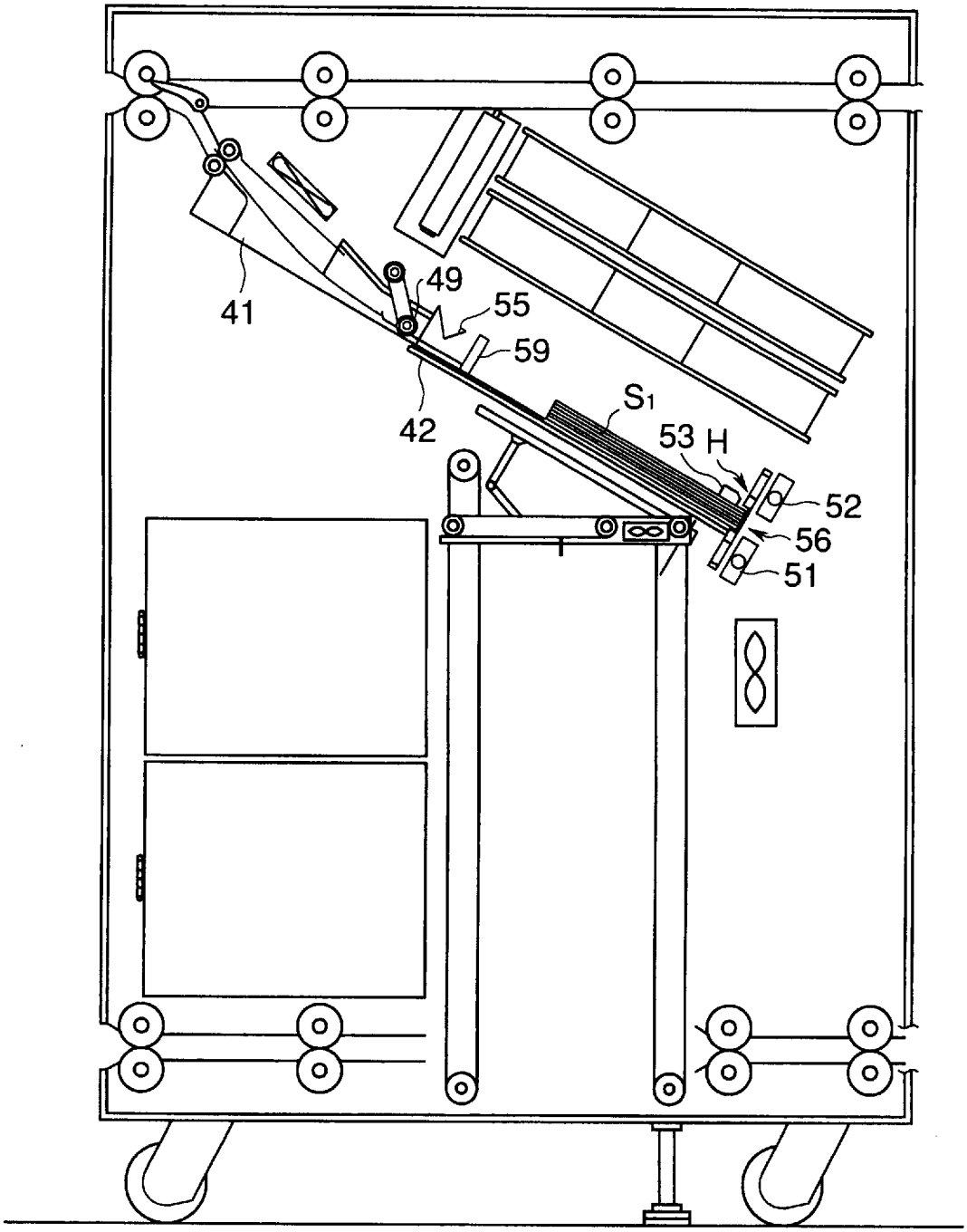

FIG. 19 shows a condition that the sheet bundle S1 clamped by the clamp member 53 is set to the back abutment position H. The sheet bundle S1 clamped by the clamp member 53 is linearly shifted (without applying excessive stress to the sheet bundle S1) to the back abutment position H while being guided by the auxiliary guide plate 42. Incidentally, a distance between the abutment member 59 and the heater 56 (H) is greater than the length of the sheet bundle S1 to be book-bound.

Figure 20A:
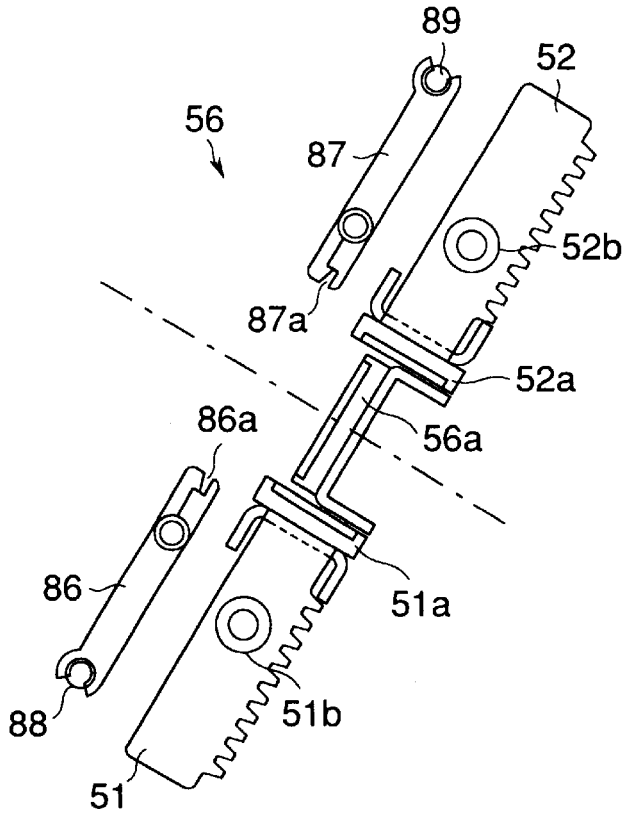
FIG. 20A is a sectional view of a heater portion of the bookbinding apparatus.

In FIG. 20A showing a schematic front view of the tape heating device 56, the tape heating device 56 has a back surface heater 56*a* for heating the strip-shaped bind tape Ta (T2, T5, T6, T7, T8) cut from the wound bind tape T. Side heaters 51, 52 disposed on both sides of the tape heating device 56 have inner heaters 51*a*, 52*a* and side rollers 51*b*, 52*b*. In the vicinity of the side heaters 51, 52, there are disposed tape guides 86, 87 having inner ends including guide portions 86*a*, 87*a* and base ends pivotally mounted on support shafts 88, 89, respectively.

Figure 20B:
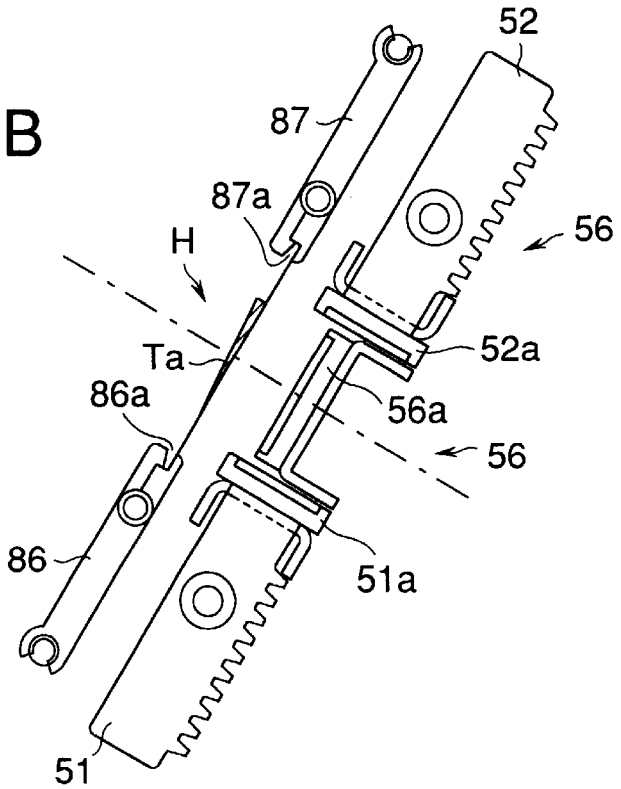
FIG. 20B is a sectional view showing a condition that the bind tape is set at the heater portion.

FIG. 20B to FIG. 25 show the operation of the tape heating device 56. FIG. 20B shows a condition that the bind tape Ta is supplied by the bind tape supplying device 630 to the back abutment position H while being guided by the tape guides 86, 87.

Figure 21A:
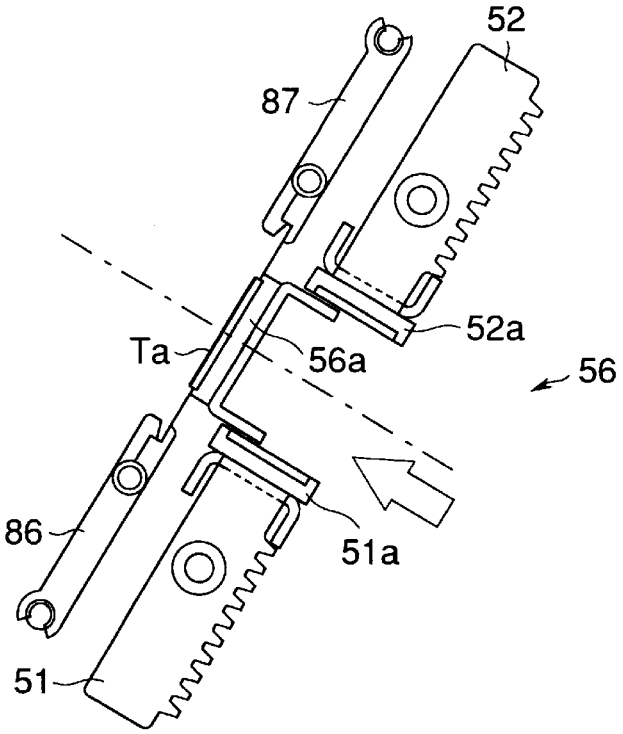
FIG. 21A is a sectional view showing a condition that a back side heater of the heater portion is shifted to a back surface of the bind tape and the heating is started.
Figure 21B:
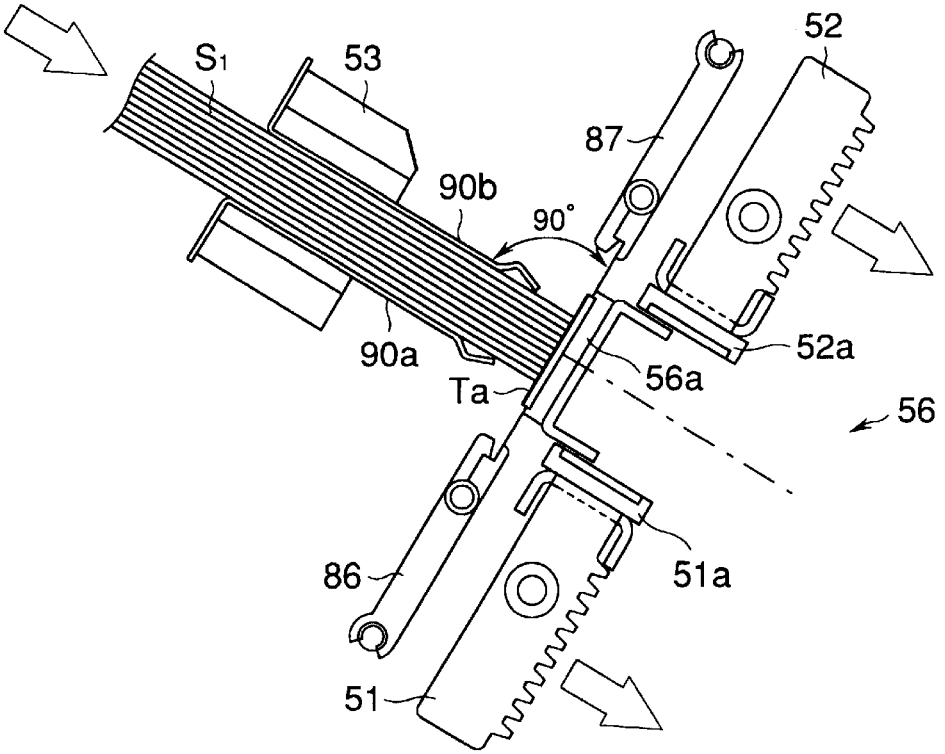
FIG. 21B is a sectional view showing a condition that the sheet bundle is urged against the heated bind tape.

When the bind tape Ta is supplied to the back abutment position H, the back surface heater 56*a* is shifted to start the pre-heating of the bind tape Ta (FIG. 21A). FIG. 21B shows a condition that the aligned sheet bundle S1 clamped by the clamp member 53 has been shifted (from the alignment tray 41) to the back abutment position H and the back of the sheet bundle S1 is urged against the bind tape (adhesive layer). In this case, in the vicinity of the back of the sheet bundle S1, the sheet bundle is guided by upper and lower regulating guides 90*a*, 90*b* to prevent the sheet bundle from being spread due to the curl in the sheet S, weight of the sheet bundle and/or heat from the heaters.

Figure 22A:
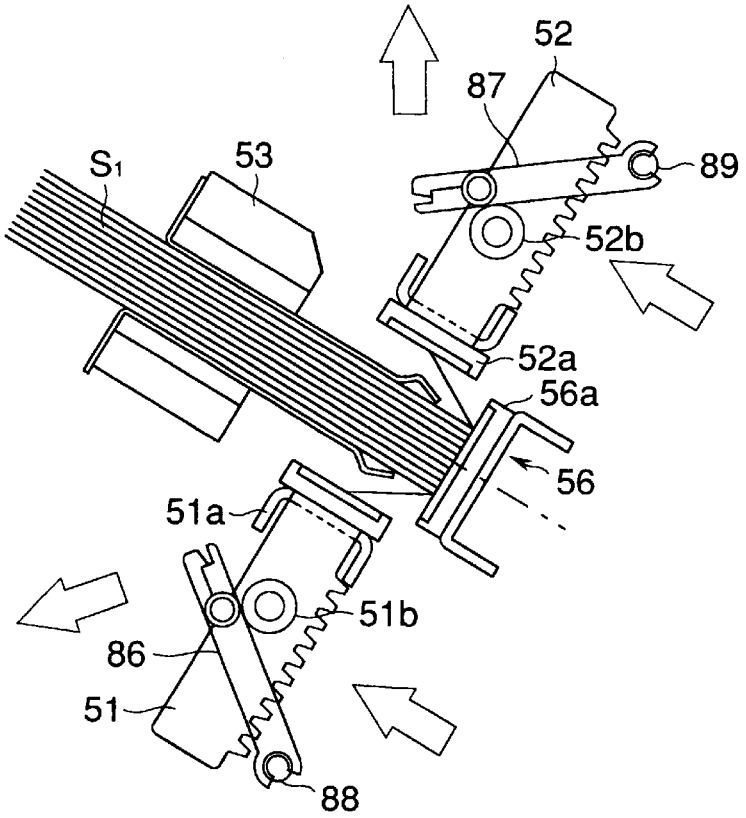
FIGS. 22A, 22B, 23A and 23B are sectional views for explaining a side binding operation performed by side heaters of the heater portion.

When the binding of the back of the sheet bundle S1 is completed, as shown in FIG. 22A, the side heaters 51, 52 start the side binding while the tape guides 86, 87 are being retarded and the both end portions of the bind tape Ta are being bent upwardly. In this case, the upper and lower regulating guides 90*a*, 90*b* are retarded from the tip end (back) of the sheet bundle as the side heaters are shifted.

Figure 22B:
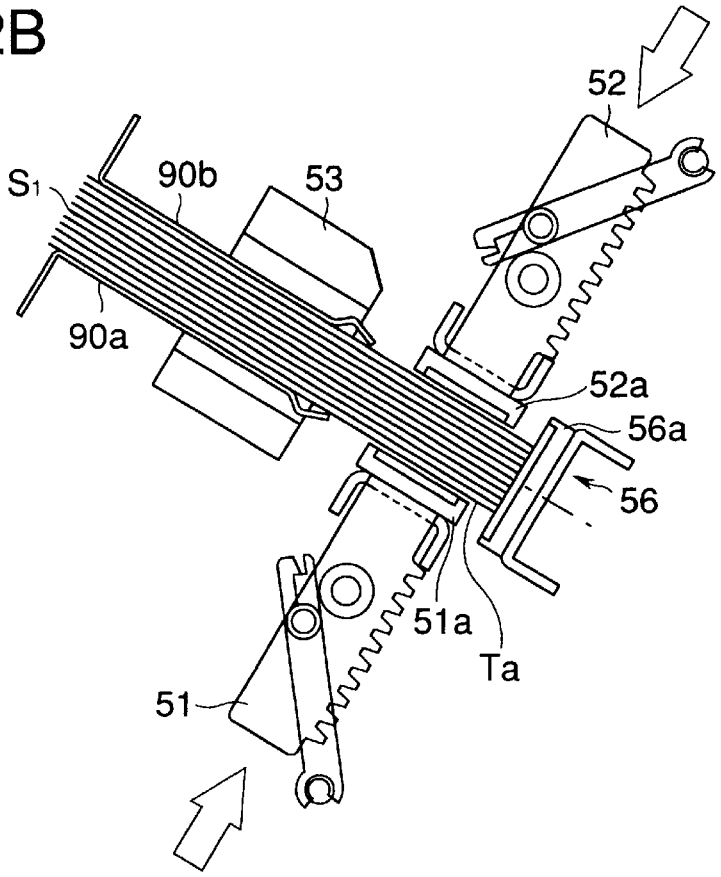
Figure 23A:
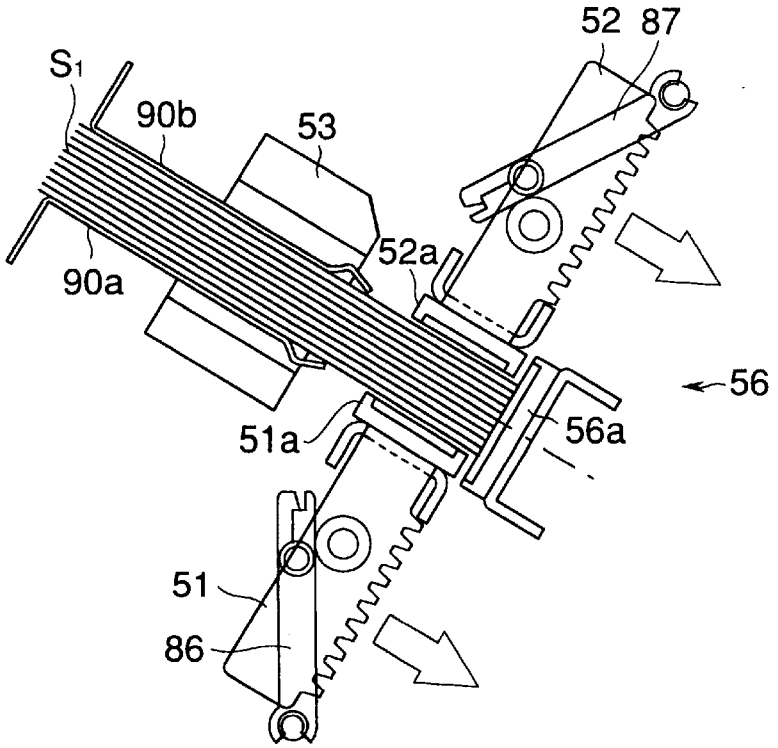

FIG. 22B shows a condition that the side binding of the sheet bundle S1 is being performed. As shown in FIG. 22B, the side heaters 51, 52 are shifted in directions shown by the arrows to urge the bind tape Ta against lower side surfaces of the sheet bundle S1, thereby effecting the side binding. In this case, as mentioned above, the tape guides 86, 87 and the upper and lower regulating guides 90*a*, 90*b* are retarded as shown. When the side binding of the sheet bundle is completed, as shown in FIG. 23A, the side heaters 51, 52 are shifted in directions shown by the arrows while urging the bent portions of the bind tape against the side surfaces of the sheet bundle, thereby finishing the bent portions of the bind tape.

Figure 23B:
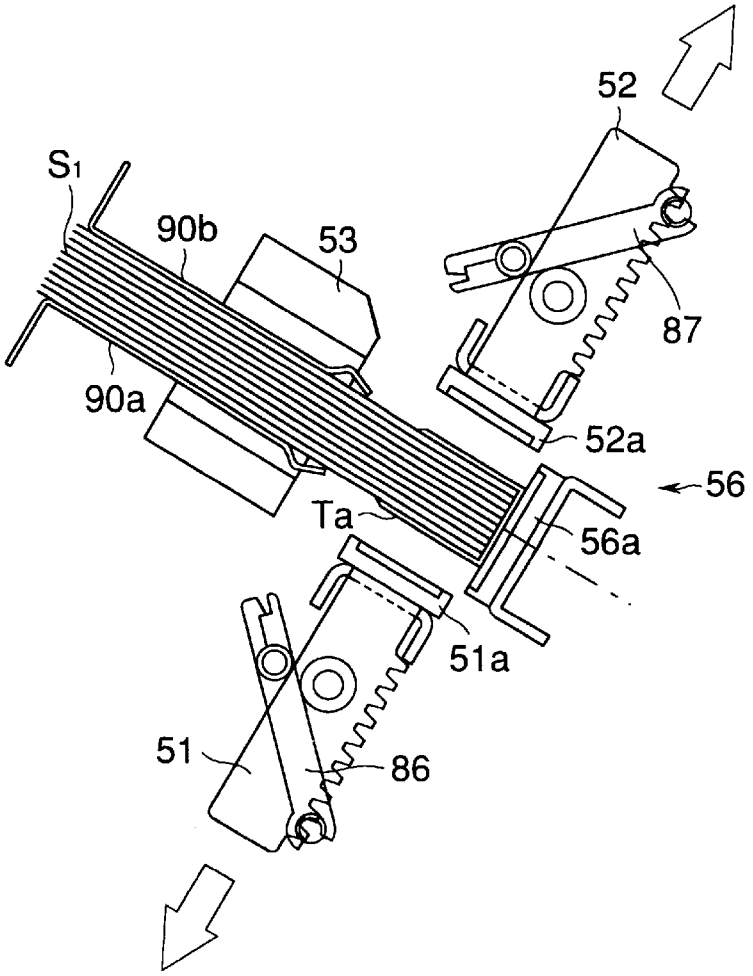

Then, as shown in FIG. 23B, the side heaters 51, 52 are shifted in directions shown by the arrows, thereby releasing the pressure against the sheet bundle.

Figure 24A:
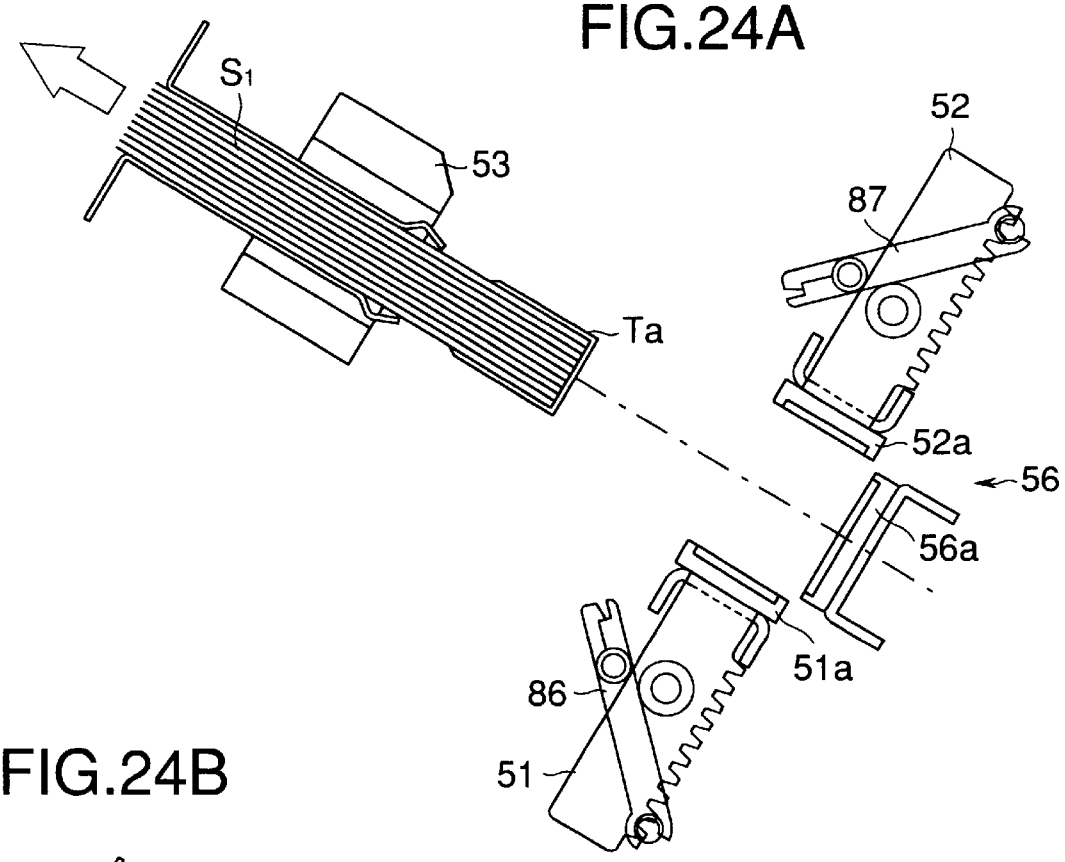
FIGS. 24A, 24B and 25 are sectional views for explaining the operation of the heater portion and a retarding movement of the sheet bundle after the bookbinding is finished.
Figure 24B:
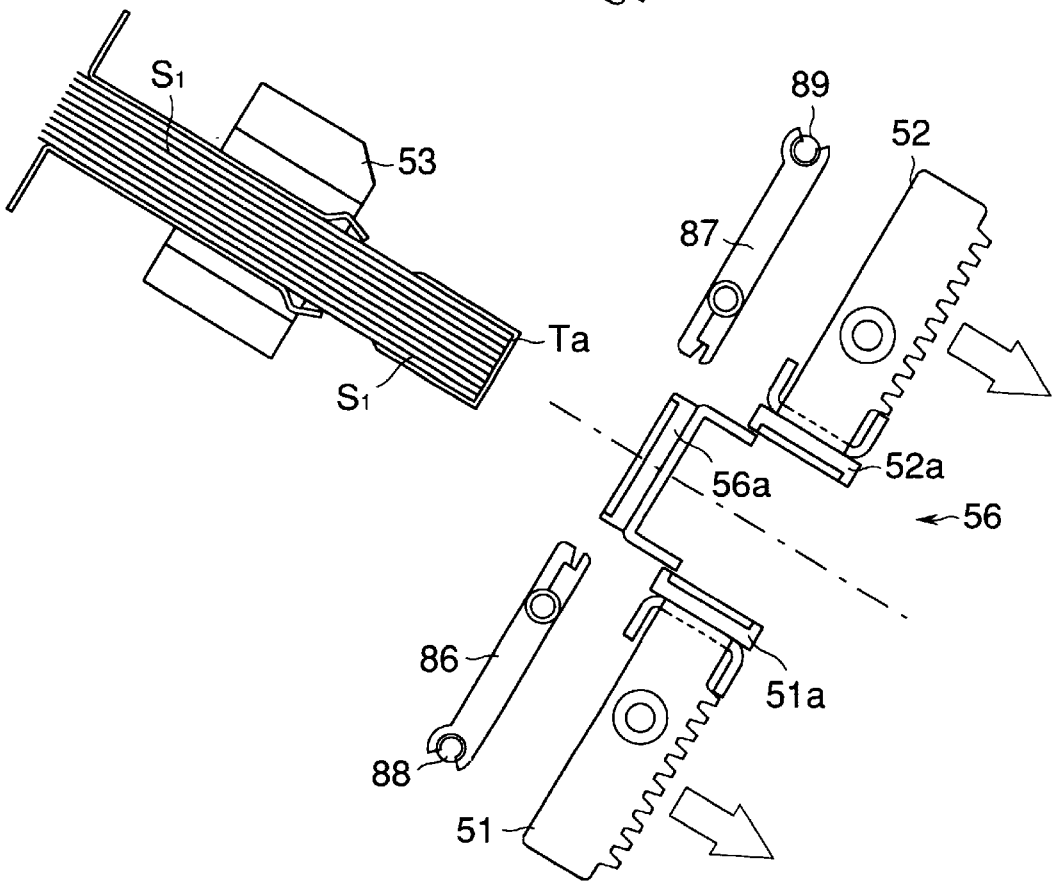
Figure 25:
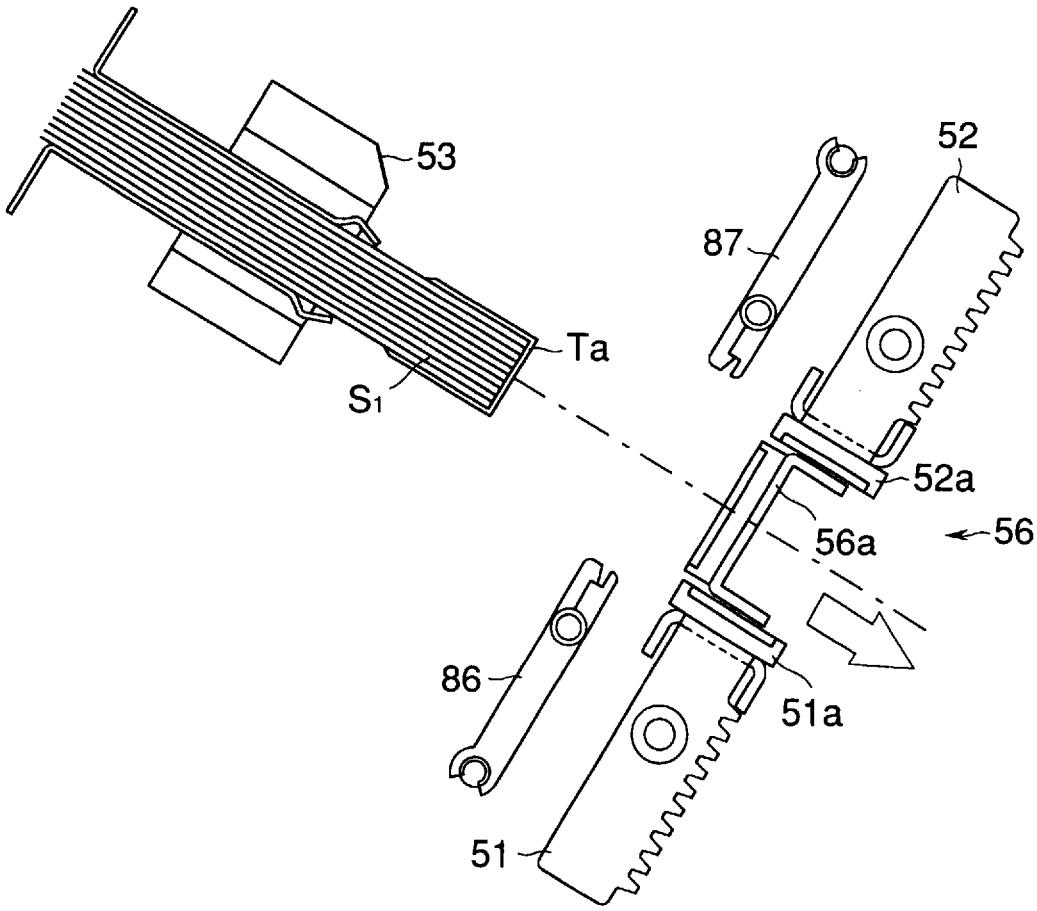

When the pressure of the side heaters 51, 52 is released, the book-bound sheet bundle S1 is retarded from the back abutment position H by means of the clamp member (sheet bundle convey means) 53 to shift the book-bound sheet bundle S1 to the transferring position (FIG. 26) to the carriage 60 (refer to FIG. 24A). As the book-bound sheet bundle S1 is retarded from the back abutment position H, the side heaters 51, 52 and back surface heater 56*a* are returned to their retard positions for preparing for the next bind tape Ta, as shown in FIGS. 24B and 25.

Figure 26:
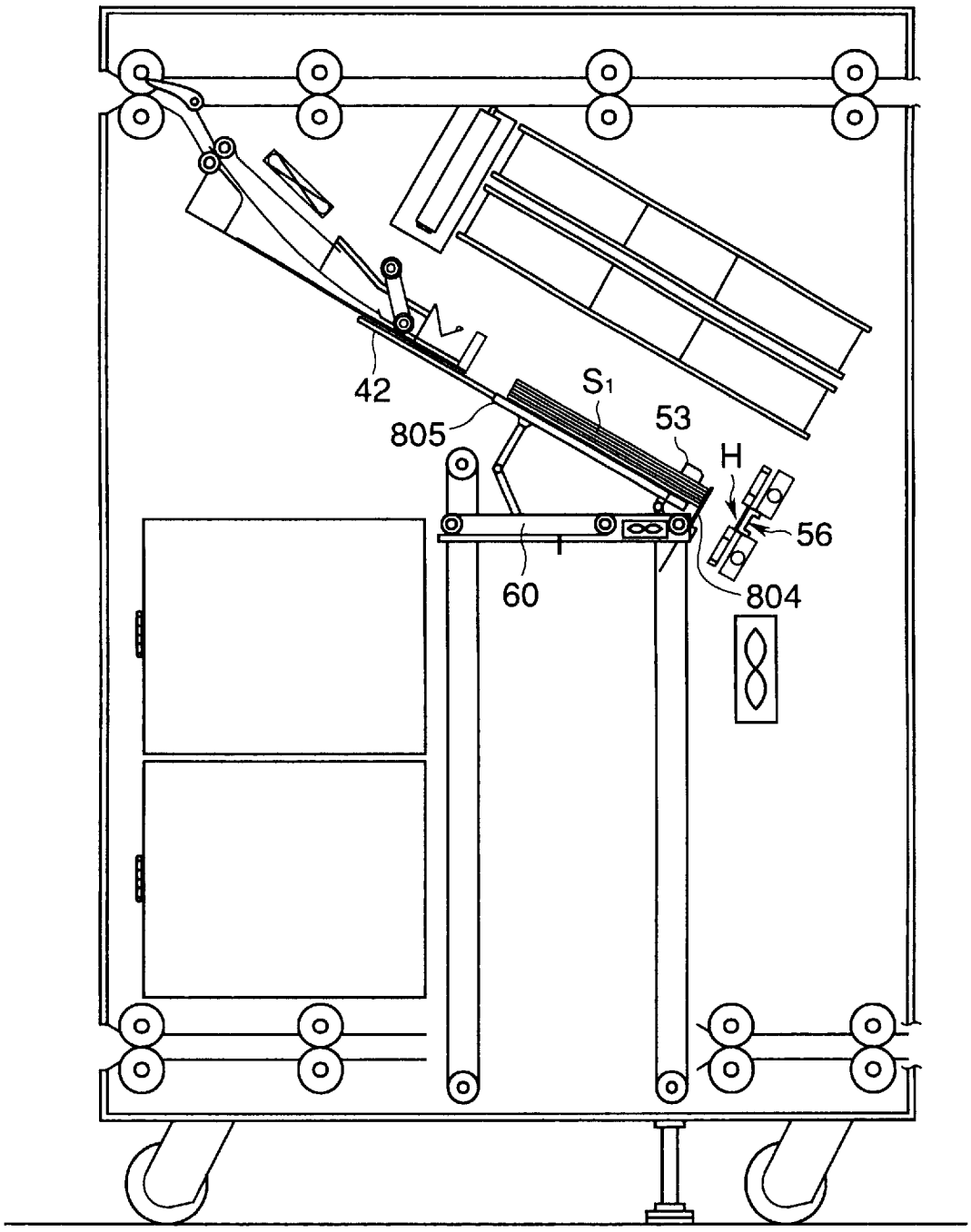
FIGS. 26 to 28 are sectional views for explaining an operation by which the book-bound sheet bundle is transferred to a carriage.

FIG. 26 shows a condition that the book-bound sheet bundle S1 has been shifted to the transferring position to the carriage 60 by means of the clamp member 53 while being guided by the auxiliary guide plate 42. While the sheet bundle S1 is being bookbound at the back abutment position H, the sheet bundle supporting bar 805 and the sheet bundle trail end supporting plate 804 of the carriage 60 are rotated so that the sheet bundle supporting bar 805 cooperates with the auxiliary guide plate 42 to support the lower surface of the sheet bundle S1 (the sheet bundle supporting bar 805 is rotated in a direction shown by the arrow Y in FIG. 15).

After the bookbinding is completed, the book-bound sheet bundle S1 is shifted by the clamp member 53 in a direction shown by the arrow V (FIG. 15) to separate the sheet bundle from the heater 56. Thereafter, the sheet bundle trail end supporting plate 804 is shifted between the lifted end of the sheet bundle and the heater 56.

Figure 27:
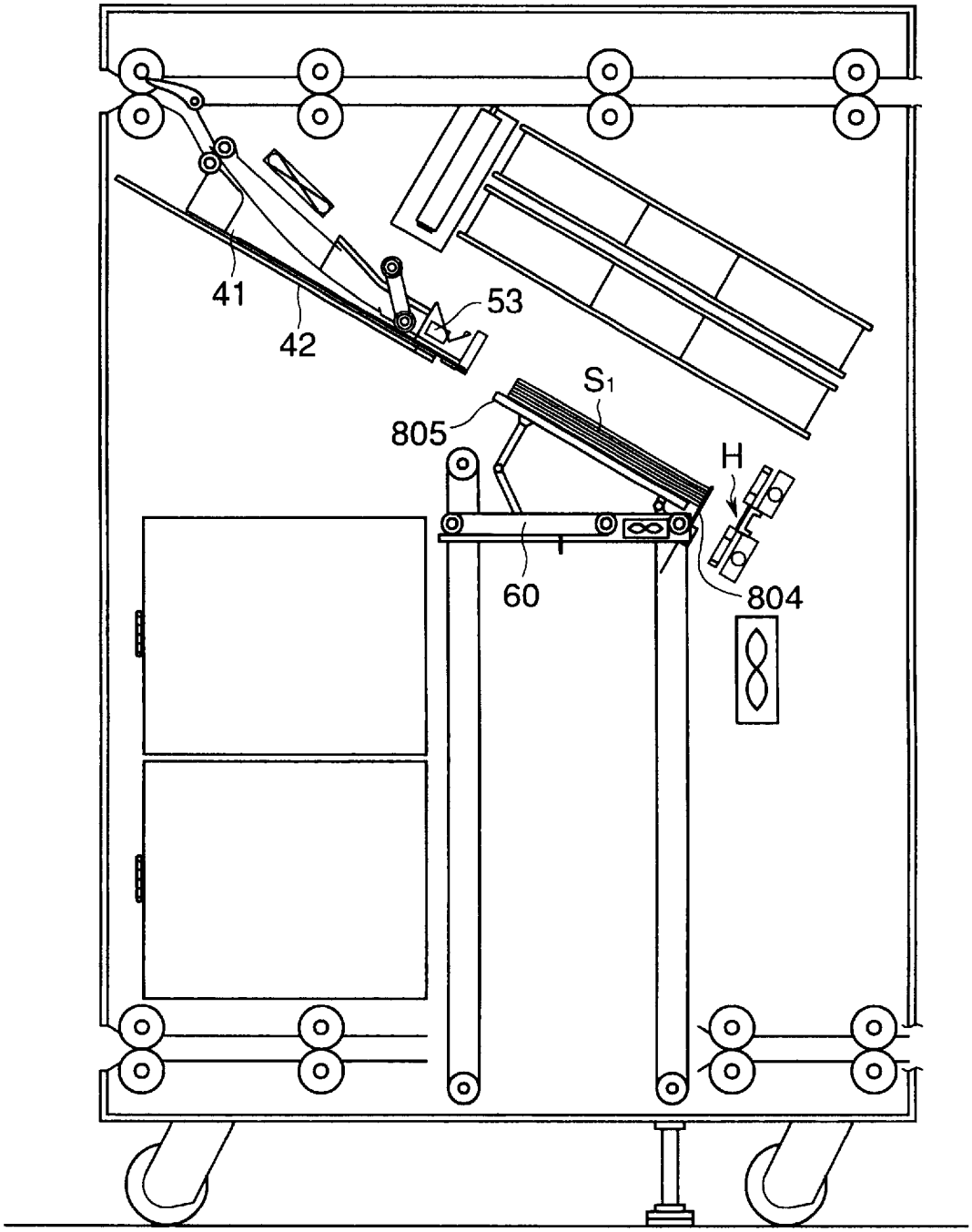

FIG. 27 shows a condition that the clamp member 53 is separated from the sheet bundle S1 and the end of the sheet bundle S1 abuts against the sheet bundle trail end supporting plate 804 to be supported in a direction shown by the arrow X (FIG. 15).

The sheet bundle supporting bar 805 is further shifted in the direction Y (FIG. 15), with the result that the lower surface of the sheet bundle S1 is supported only by the sheet bundle trail end supporting plate 804. Thereafter, the clamp member 53 and the auxiliary guide plate 42 are returned toward the alignment tray 41 (FIG. 27). Since the sheet bundle S1 is lifted (by the sheet bundle supporting bar 805) above a shifting path of the auxiliary guide plate 42, the clamp member 53 and the auxiliary guide plate 42 can be returned to the alignment tray 41 without slidingly contacting with the lower surface of the sheet bundle.

Figure 28:
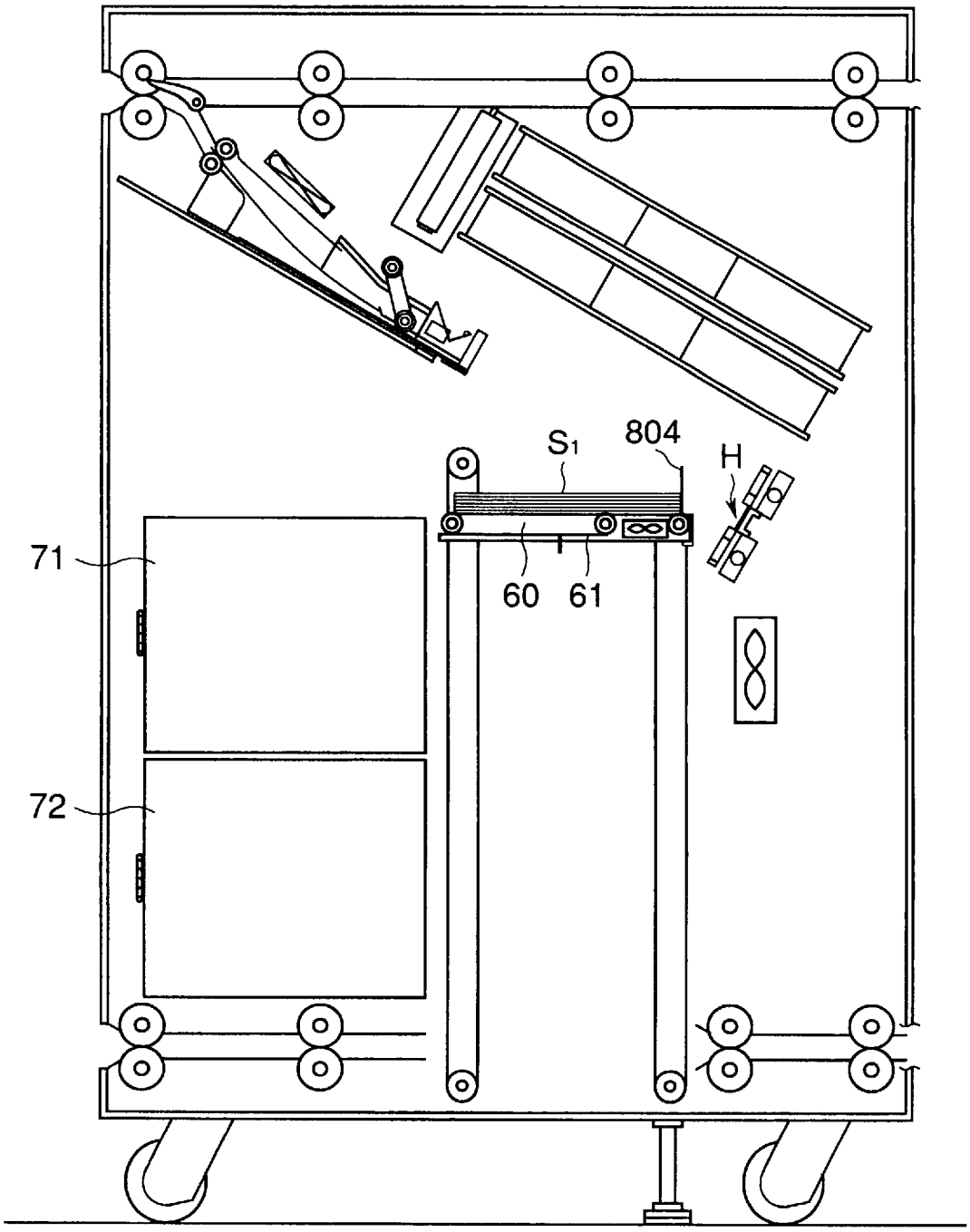

Incidentally, the auxiliary guide plate 42 and the supporting bar 805 are offset from each other in a comb-shaped pattern to permit the cross-over. When the clamp member 53 and the auxiliary guide plate 42 are returned to the alignment tray 41, the supporting bar 805 is shifted in a direction shown by the arrow Z, thereby transferring the book-bound sheet bundle S1 onto the convey belt 61 (FIG. 28).

Figure 29:
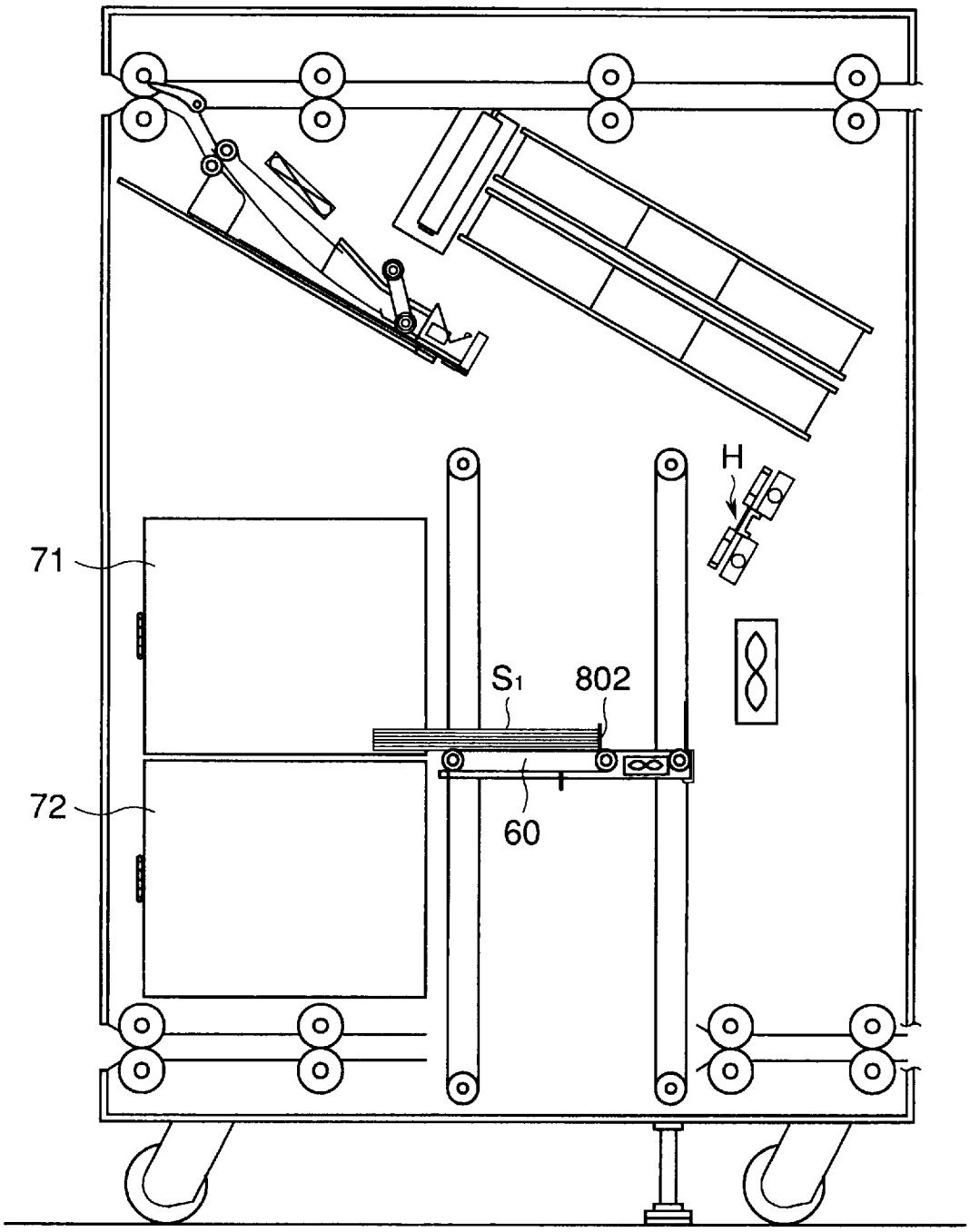
FIG. 29 is a sectional view showing a condition that the book-bound sheet bundle is being contained in an upper stacker by the carriage.
Figure 30:
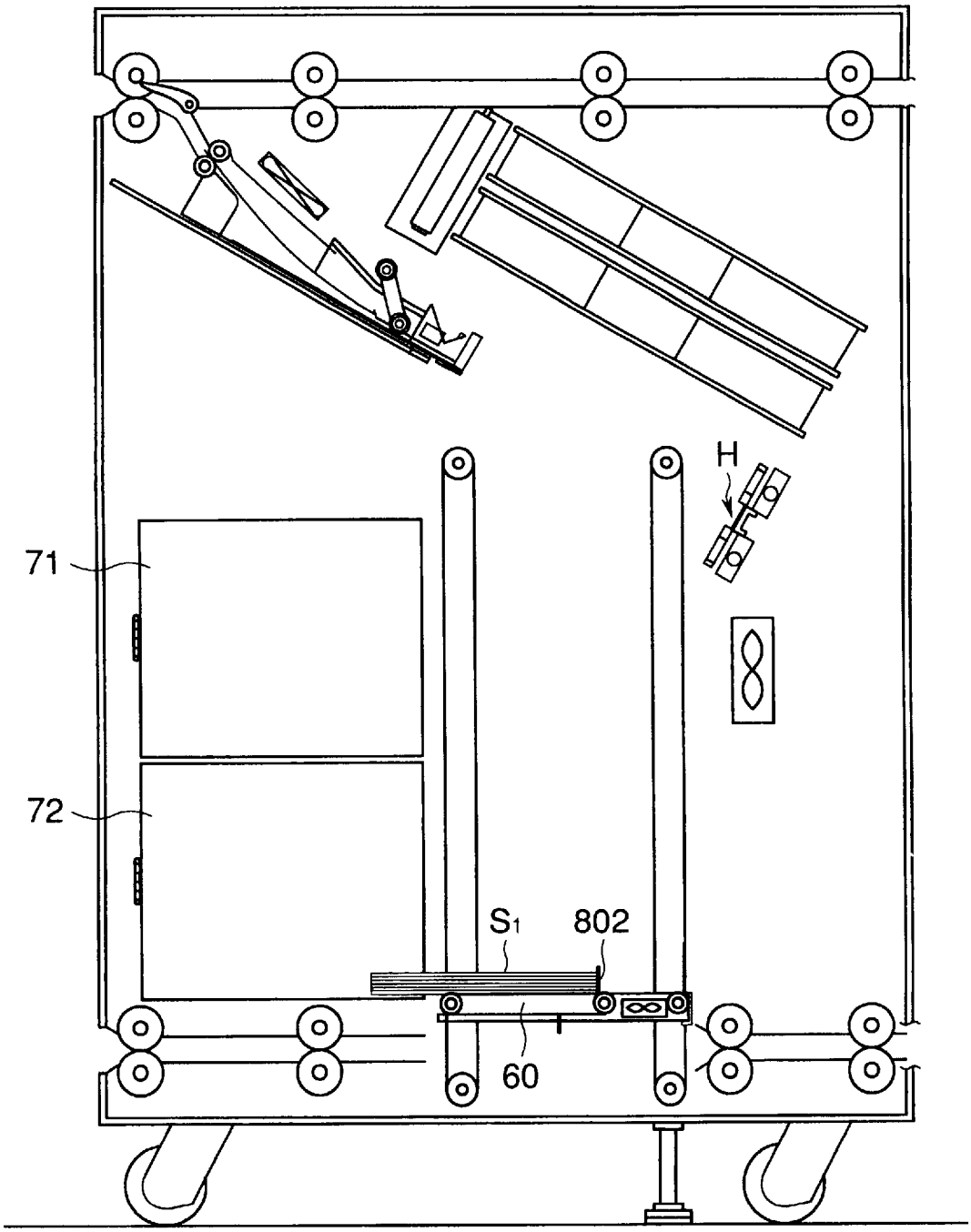
FIG. 30 is a sectional view showing a condition that the book-bound sheet bundle is being contained in a lower stacker by the carriage.

FIGS. 29 and 30 show conditions that the book-bound sheet bundle is being contained in the stackers 71, 72, respectively. The book-bound sheet bundle S1 on the carriage 60 is contained in the stacker 71 or 72 by the convey belt 61 and the pushing member 80.

Figure 31:
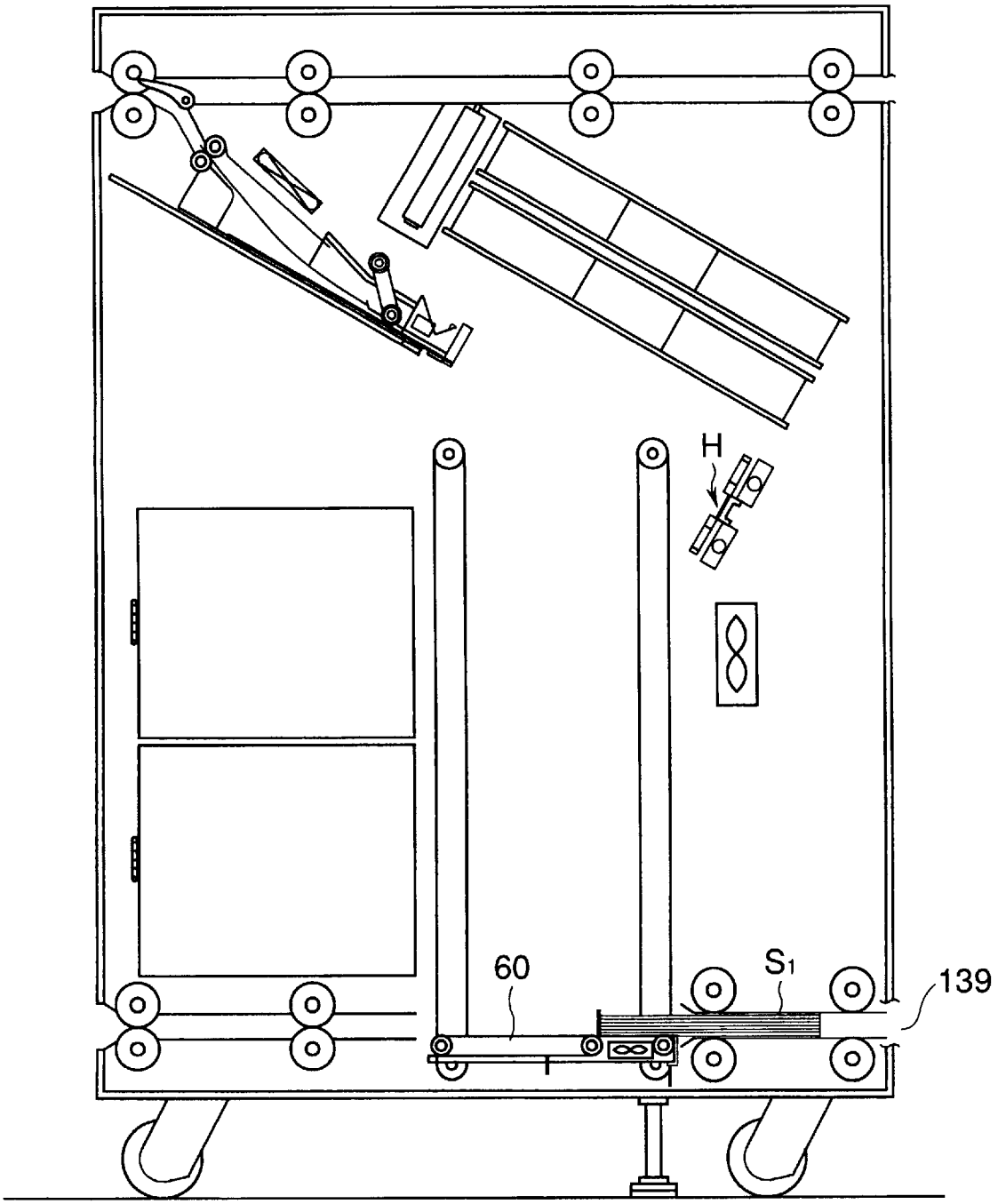
FIG. 31 is a sectional view showing a condition that the book-bound sheet bundle is being discharged out of the bookbinding apparatus by the carriage.

On the other hand, when the book-bound sheet bundle S1 on the carriage 60 is not contained in the stacker 71 or 72, as shown in FIG. 31, the book-bound sheet bundle S1 is discharged, out of the apparatus through the second discharge opening 139.

Figure 32:
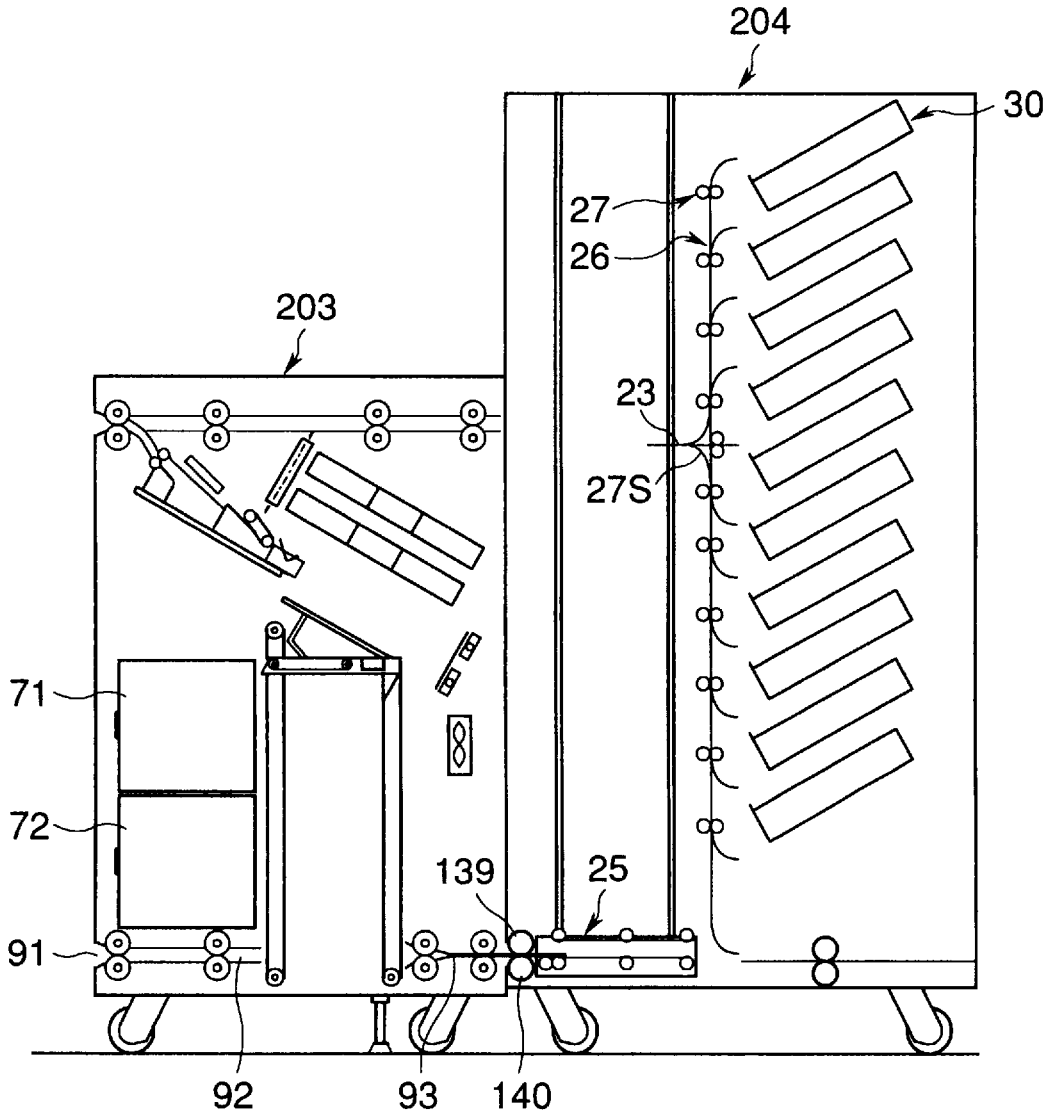
FIG. 32 is a sectional view showing a condition that the book-bound sheet bundle discharged from the bookbinding apparatus is being transferred to an elevator of a sorting and containing apparatus.
Figure 33A:
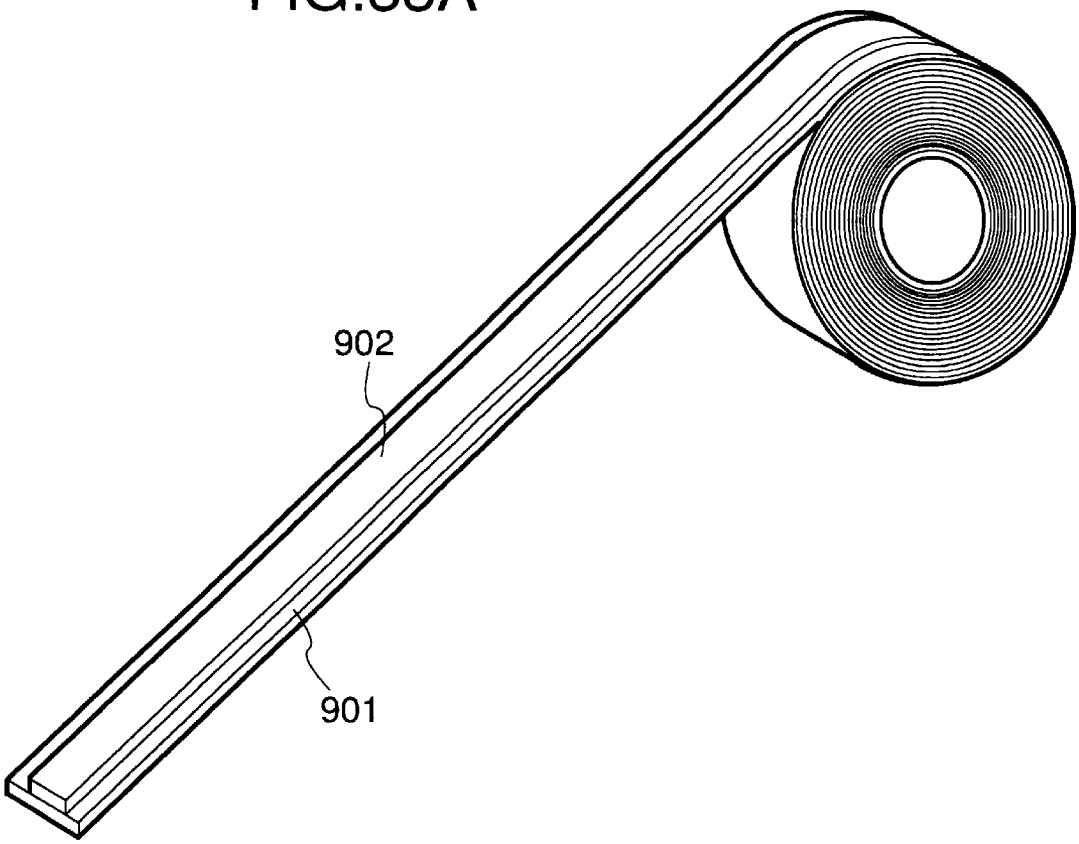
FIG. 33A is a perspective view of a conventional wound bind tape.
Figure 33B:
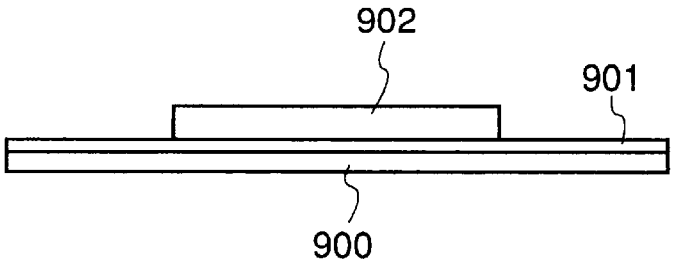
FIG. 33B is a sectional view of the bind tape.
Figure 34:
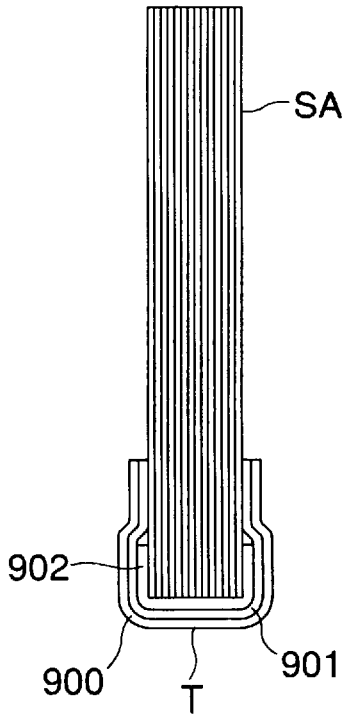
FIG.34 PRIOR ART
FIG. 34 is a sectional view of a sheet bundle book-bound by using a strip-shaped bind tape cut from the conventional wound bind tape.
Figure 35:
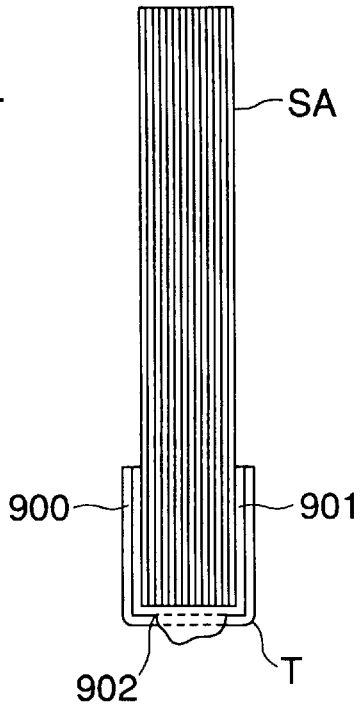
FIG.35 PRIOR ART
FIG. 35 is a sectional view showing a condition the bookbinding is performed in such a manner that a bound edge of the sheet bundle is not swollen.

In FIG. 32, the book-bound sheet bundle S1 discharged from the bookbinding apparatus 203 is transferred onto the elevator 25 at the lower portion of the sorting and containing apparatus 204. By shifting the elevator 25 in the vertical direction, the book-bound sheet bundle S1 is discharged onto a selected discharge tray 30. When the book-bound sheet bundle S1 is not required to be contained in the discharge tray 30, the sheet bundle is discharged out of the sorting and containing apparatus 204 through the elevator 25 positioned at a lowermost position.

Further, the non-bound sheet bundle or the sheet is discharged from the image forming apparatus to the sorting and containing apparatus through the bookbinding apparatus, the carriage 60 is shifted to a lowermost position in the bookbinding apparatus 203. Then, the non-bound sheet bundle or the sheet is introduced into the bookbinding apparatus through a second inlet opening 91 disposed below the stacker 72 and is passed through a left lower convey path 92, the carriage 60 and a right lower convey path 93 to be discharged from the second discharge opening 139. With this arrangement, when the non-bound sheet bundle is discharged out of the sorting and containing apparatus 204, the sheet bundle S1 can be discharged from the apparatus without passing through the convey path 26 of the sorting and containing apparatus 204.

The present invention is not limited to the above-mentioned embodiments. For example, while an example that the adhesive layer 502 on the bind tape includes the base block 502A and a plurality of auxiliary blocks 502B, 502C, 502D was explained, by reducing the kinds of sheet bundles to be treated, a single auxiliary block may be used together with the base block.

What is claimed is:

1. A bookbinding apparatus comprising:

bind tape containing means for containing a bind tape including a tape substrate and adhesive layers for bonding a sheet bundle, with the adhesive layers disposed along a longitudinal direction with a predetermined block pattern depending upon sizes of sheet bundles;

convey means for conveying the bind tape contained in said bind tape containing means;

cutting means for cutting a length of the bind tape conveyed by said convey means in accordance with the size of the sheet bundle to be book-bound;

control means for controlling said cutting means in such a manner that the bind tape is cut at a position on which said adhesive layer is not coated between blocks of the block pattern; and binding means for urging the cut length bind tape against the sheet bundle.

2. A bookbinding apparatus according to claim 1, wherein the adhesive of the adhesive layers is heat-soluble, and said binding means includes a heating means for melting the adhesive, and a pressurizing means urging the heated adhesive and the bound edge of the sheet bundle against each other.

3. An image forming apparatus having a bookbinding apparatus for binding sheets on which images are formed to obtain a book-bound sheet bundle, comprising:

image forming means for forming an image on the sheet;

alignment means for stacking and aligning the sheets on which the images are formed;

bind tape containing means for containing a bind tape including a tape substrate and adhesive layers for bonding a sheet bundle, with the adhesive layers disposed along a longitudinal direction with a predetermined block pattern depending upon sizes of sheet bundles;

convey means for conveying the bind tape contained in said bind tape containing means;

cutting means for cutting a length of the bind tape conveyed by said convey means in accordance with the size of the sheet bundle to be book-bound;

control means for controlling said cutting means in such a manner that the bind tape is cut at a position on which said adhesive layer is not coated between blocks of the block pattern; and binding means for binding the length of cut bind tape to a bound edge of a sheet bundle formed by aligning the sheets by said alignment means; and discharge means for discharging the sheet bundle bond by the bind tape.

4. An image forming means according to claim 3, wherein the adhesive of said adhesive layers is heat-soluble, and said urging means includes a heating means for melting the adhesive pressurizing means for urging the heated adhesive and the bound edge of the sheet bundle against each other.

5. A method of binding sheet bundles using a bind tape, comprising the steps of:

providing a bind tape container containing a bind tape including a tape substrate and adhesive layers for binding a sheet bundle, with the adhesive layers disposed along a longitudinal direction with a predetermined block pattern depending upon sizes of sheet bundles;

conveying the bind tape contained in the bind tape container;

cutting a length of the conveyed bind tape in accordance with the size of the sheet bundle to be book bound;

controlling the cutting in such a manner that the bind tape is cut at a portion on which the adhesive layer is not coated between blocks of the block pattern; and urging the cut length of bind tape against the sheet bundle.

6. A method according to claim 5, further comprising the step of providing the block pattern of the adhesive layer with one base block corresponding to a minimum size of a sheet bundle and one or more auxiliary blocks corresponding to a maximum size of a sheet bundle; and cutting the bind tape at positions between the blocks where the adhesive layers are not positioned.

7. A method according to claim 6, further comprising the step of cutting the bind tape between the blocks to book bind a sheet bundle having a predetermined size, wherein the bind tape is cut at a portion having a non-used auxiliary block.

8. A method according to claim 6 further comprising the step of cutting the bind tape between the blocks to book bind a sheet having a predetermined size, with the bind tape being cut at a portion having a non-used auxiliary block into small pieces smaller than the length of the auxiliary block.

9. A method according to claim 5, wherein the bind tape is contained by winding an elongated strip of bind tape in the container, and the bind tape is pulled from the container.

10. A method according to claim 5, further comprising the step of providing the bind tape with markings for identifying cut positions to be cut in accordance with the size of the sheet bundle to be book bound; and providing the bind tape container with a detector for detecting the markings, wherein the bind tape is cut based on the detected markings.

* * * * *

UNITED STATES PATENT AND TRADEMARK OFFICE

CERTIFICATE OF CORRECTION

PATENT NO. : 5,833,423

DATED : November 10, 1998

INVENTOR(S) : Yamaguchi et al.

It is certified that error appears in the above-identified patent and that said Letters Patent is hereby corrected as shown below:

COLUMN 5:

Line 41, "be accommodeted to" should read --accommodate--.

COLUMN 6:

Line 21, "is not existed" should read --does not exist--.
Line 23, "heater" should read --heated--.

COLUMN 7:

Line 9, "be evaporated;" should read --evaporate;--.
Line 12, "be evaporated," should read --evaporate,--.
Line 39, "being evaporated" should read --evaporating--.
Line 42, "as is" should read --as--.

COLUMN 8:

Line 42, "generate" should read --generated--.

COLUMN 11:

Line 60, "aligning" should read --and aligning--.

COLUMN 12:

Line 44, "roller" should read --rollers--.

UNITED STATES PATENT AND TRADEMARK OFFICE

CERTIFICATE OF CORRECTION

PATENT NO. : 5,833,423

DATED : November 10, 1998

INVENTOR(S) : Yamaguchi et al.

It is certified that error appears in the above-identified patent and that said Letters Patent is hereby corrected as shown below:

COLUMN 13:

Line 38, "synchronous" should read --synchronism--.
Line 50, "synchronous" should read --synchronism--.

Signed and Sealed this

Fourth Day of April, 2000

*Attest:*

Q. TODD DICKINSON

*Attesting Officer*

*Director of Patents and Trademarks*